US012497744B2

(12) United States Patent
Adam et al.

(10) Patent No.: US 12,497,744 B2
(45) Date of Patent: Dec. 16, 2025

(54) CONTAINMENT PLOW

(71) Applicant: Douglas Dynamics, L.L.C., Milwaukee, WI (US)

(72) Inventors: Derek William Adam, Milwaukee, WI (US); Benjamin Chadwick Altfillisch, Milwaukee, WI (US); David N. Bloxdorf, Hubertus, WI (US); Christopher David Damon, Milwaukee, WI (US); Christopher Aaron Horn, Menomonee Falls, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 756 days.

(21) Appl. No.: 17/806,835

(22) Filed: Jun. 14, 2022

(65) Prior Publication Data

US 2023/0399803 A1 Dec. 14, 2023

(51) Int. Cl.
*E01H 5/06* (2006.01)

(52) U.S. Cl.
CPC ..... *E01H 5/061* (2013.01); *E01H 5/065* (2013.01)

(58) Field of Classification Search
CPC ..... E01H 5/061; E01H 5/062; E01H 5/065; E01H 5/067
See application file for complete search history.

(56) References Cited

U.S. PATENT DOCUMENTS 1,383,409 A 7/1921 Liddell
3,199,234 A 8/1965 Reissinger
3,772,803 A * 11/1973 Cote ..... E01H 5/062 172/701.3
5,344,254 A 9/1994 Sartain
5,697,172 A 12/1997 Verseef
5,819,443 A 10/1998 Winter
6,823,615 B2 11/2004 Strait
(Continued)

FOREIGN PATENT DOCUMENTS

DE 3205974 A1 9/1983

OTHER PUBLICATIONS

2022 Horst Welding; HLA Snow _ Edge Flex.html, printed Aug. 30, 2023.
(Continued)

*Primary Examiner* — Joseph M Rocca
*Assistant Examiner* — Robert E Pezzuto
(74) *Attorney, Agent, or Firm* — Wood Herron & Evans LLP

(57) ABSTRACT

A containment plow adapted to be mounted to a vehicle such as a skid steer, a wheeled loader, or a tractor comprises a moldboard frame, a moldboard mounted to the moldboard frame, a wing pivotally connected to the moldboard frame adjacent each end of the moldboard, a moldboard cutting edge mounted to a lower edge of the moldboard and comprising a plurality of cutting edge segments, and a wing cutting edge mounted to a lower edge of each wing. Each moldboard cutting edge segment is mounted so as to have two rotational degrees of freedom movement relative to the moldboard and one translational degree of freedom movement relative to the moldboard. Each wing cutting edge is mounted so as to have two rotational degrees of freedom movement relative to the wing.

22 Claims, 22 Drawing Sheets

(56) References Cited

U.S. PATENT DOCUMENTS

| | | | | |
|---|---|---|---|---|
| 7,089,692 | B2 | 8/2006 | Strait | |
| 7,107,709 | B2 | 9/2006 | Hamel | |
| 7,555,853 | B2 | 7/2009 | Paonessa | |
| 7,631,441 | B2 | 12/2009 | Hunt | |
| 7,658,022 | B2 | 2/2010 | Strait | |
| 7,975,409 | B2 | 7/2011 | Paonessa | |
| 8,776,405 | B2 | 7/2014 | Paonessa | |
| 9,051,700 | B2 | 6/2015 | Summers et al. | |
| 9,255,370 | B2 | 2/2016 | Paonessa | |
| 9,611,604 | B2 * | 4/2017 | Vigneault | E01H 5/063 |
| 10,480,140 | B2 | 11/2019 | Vigneault | |
| 10,851,507 | B2 | 12/2020 | Guggino et al. | |
| 10,851,508 | B2 | 12/2020 | Guggino et al. | |
| 10,865,533 | B2 | 12/2020 | Stephan | |
| 10,865,534 | B2 | 12/2020 | Martin et al. | |
| 10,889,949 | B2 | 1/2021 | Stephan | |
| 11,203,852 | B2 * | 12/2021 | Vigneault | E01H 5/065 |
| 2013/0025629 | A1 | 1/2013 | Vigneault | |
| 2017/0218585 | A1 * | 8/2017 | Vigneault | E01H 5/062 |
| 2019/0203436 | A1 * | 7/2019 | Martin | E01H 5/066 |
| 2019/0323204 | A1 | 10/2019 | Vigneault | |
| 2020/0018030 | A1 | 1/2020 | Vigneault | |
| 2021/0087764 | A1 | 3/2021 | Guggino et al. | |
| 2021/0285171 | A1 | 9/2021 | Weihl | |
| 2022/0081874 | A1 | 3/2022 | Vigneault | |
| 2022/0112674 | A1 | 4/2022 | Strait et al. | |

OTHER PUBLICATIONS

Nordik Blades; Nordik Move™ _ Nordik Blades.html, printed Aug. 30, 2023.

2023 Kage Innovation; AdvantEdge.html, printed Aug. 30, 2023.

Mëtal Pless; Live Edge Snow Plow _ Mëtal Pleass.html, printed Aug. 30, 2023.

* cited by examiner

CONTAINMENT PLOW

RELATED APPLICATIONS

N/A

FIELD OF THE INVENTION

This invention relates generally to plows, and more particularly to snow plows of the containment variety.

BACKGROUND OF THE INVENTION

Containment snow plows, also known as pusher plows or box plows, are typically mounted to equipment such as skid steers, wheeled loaders, or tractors. As such, containment plows are typically heavier duty than straight blade plows or V-blade plows that are mounted on pickup trucks, and are designed to push heavier snow loads.

A typical containment plow has a moldboard, a cutting edge mounted to a lower edge of the moldboard, a wing attached to each end of the moldboard, and a mounting frame for attaching the plow to the vehicle. On some containment plows, the wings are fixed relative to the moldboard and oriented forward and perpendicular thereto, thus providing the containment function. On other containment plows, the wings are pivoted relative to the moldboard, and may be oriented forward and perpendicular thereto, parallel thereto, or rearward and perpendicular thereto. When the wings are oriented rearward and perpendicular to the moldboard, the plow is configured to perform a back-dragging containment function.

Ideally a containment plow, or any plow for that matter, has the capability to accommodate obstructions and surface irregularities encountered during plowing. The ability to accommodate obstructions reduces damage to the plow, and the ability to accommodate surface irregularities reduces the number of passes the plow must make to completely clear the pavement of snow and ice. Obstructions may take the form of curbs, manhole covers, and the like. Surface irregularities may take the form of deviations in the pavement from true flat (i.e. dips or rises in the pavement) or deviations in the pavement from true horizontal.

While advancements in plow technology and in particular containment plow technology have been made to better accommodate obstructions and surface irregularities, nevertheless further improvement is desired.

SUMMARY OF THE INVENTION

In one aspect, a containment plow adapted to be mounted to a vehicle such as a skid steer, a wheeled loader, or a tractor comprises a moldboard frame, a moldboard mounted to the moldboard frame, a wing pivotally connected to the moldboard frame adjacent each end of the moldboard, a moldboard cutting edge mounted to a lower edge of the moldboard and comprising a plurality of cutting edge segments, and a wing cutting edge mounted to a lower edge of each wing. Each moldboard cutting edge segment is mounted so as to have two rotational degrees of freedom movement relative to the moldboard and one translational degree of freedom movement relative to the moldboard. Each wing cutting edge is mounted so as to have two rotational degrees of freedom movement relative to the wing.

Each moldboard cutting edge segment can be mounted to permit, independent of an adjacent segment, 1) pivoting movement about a first axis generally parallel to the lower edge of the moldboard, 2) pivoting movement about a second axis generally perpendicular to the lower edge of the moldboard, and 3) translational movement generally parallel to the lower edge of the moldboard, and each wing cutting edge can be mounted to permit 1) pivoting movement about a third axis generally parallel to the lower edge of the wing, and 2) pivoting movement about a fourth axis generally perpendicular to the lower edge of the wing.

Each moldboard cutting edge segment can be mounted to a respective moldboard cutting edge segment support plate. The support plate can be pivotally connected to the moldboard frame with a pivot pin, the pivot pin providing the pivoting movement of the segment about the first axis. Each end of the pivot pin can be positioned in a slot in a rib of the moldboard frame, the slots providing the translational movement of the segment generally parallel to the lower edge of the moldboard. The segment can be pivotally connected to the support plate with a fastener positioned medially of a length of the segment, the fastener providing the pivoting movement of the segment about the second axis.

A single biasing element can bias the segment forward relative to the lower edge of the moldboard about the first axis and downward relative to the lower edge of the moldboard.

The plow can further comprise a generally upwardly oriented link pivotally connected at a lower end to the support plate at a position aft of the pivot pin and slideably connected at an upper end to the moldboard frame. The biasing element can comprise a compression spring. The link can be positioned within the compression spring. An upper end of the compression spring can be captured against upward movement relative to the moldboard frame. Rearward pivoting movement of the segment about the first axis compresses the spring and develops a forward pivoting restoring torque, and upward translational movement of the segment develops a downward translational restoring force.

Each wing cutting edge can be mounted to a respective wing cutting edge support plate. The support plate can be pivotally connected to the wing with a first pin, the first pin providing the pivoting movement of the wing cutting edge about the third axis. The wing cutting edge can be pivotally connected to the support plate with a fastener positioned adjacent an end of the wing cutting edge nearest to the pivot connection of the wing to the moldboard frame, the fastener providing the pivoting movement of the wing cutting edge about the fourth axis.

A first biasing element can bias the wing cutting edge forward relative to the lower edge of the wing about the third axis, and a second biasing element can bias the wing cutting edge about the fourth axis so as to bias an end of the wing cutting edge furthest from the pivot connection of the wing to the moldboard frame downward relative to the lower edge of the wing.

The plow can further comprise a support plate bracket secured to a rear surface of the wing, pivot pin ears secured to the wing cutting edge support plate and to the support plate bracket, the ears pivotally receiving the first pin, the first biasing element comprising a first torsion spring encircling the first pin and having first and second legs, the first leg engaging the support plate and the second leg engaging the support plate bracket, a second pin secured to the support plate and extending generally parallel to the first pin, the second biasing element comprising a second torsion spring encircling the second pin and having first and second legs, the first leg engaging the wing cutting edge and the second leg engaging the support plate. Rearward pivoting movement of the wing cutting edge about the third axis twists the first torsion spring and develops a forward pivoting restoring torque, and upward pivoting movement of the end of the wing cutting edge furthest from the pivot connection of the wing to the moldboard frame twists the second torsion spring and develops a downward pivoting restoring torque.

The plow can further comprise an L-shaped bracket having a leg and a foot, the leg positioned against a rear surface of the support plate and the foot extending rearwardly therefrom, and a bar attached to the support plate, the support plate having a slot therein, a fastener securing the wing cutting edge to the L-shaped bracket, the fastener passing through the slot, the first leg of the second torsion spring engaging the foot of the L-shaped bracket and the second leg of the second torsion spring engaging the bar.

The wings can be pivoted to the moldboard frame so as to be positionable forward and perpendicular to the moldboard, parallel to the moldboard, and rearward and perpendicular to the moldboard.

In another aspect, a plow adapted to be mounted to a vehicle comprises a moldboard frame, a moldboard mounted to the moldboard frame, and a moldboard cutting edge mounted to a lower edge of the moldboard and comprising a plurality of cutting edge segments, each moldboard cutting edge segment mounted so as to have two rotational degrees of freedom movement relative to the moldboard and one translational degree of freedom movement relative to the moldboard.

In another aspect, a plow adapted to be mounted to a vehicle comprises a moldboard frame, a moldboard mounted to the moldboard frame, a wing pivotally connected to the moldboard frame adjacent each end of the moldboard, and a wing cutting edge mounted to a lower edge of each wing, each wing cutting edge mounted so as to have two rotational degrees of freedom movement relative to the wing.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
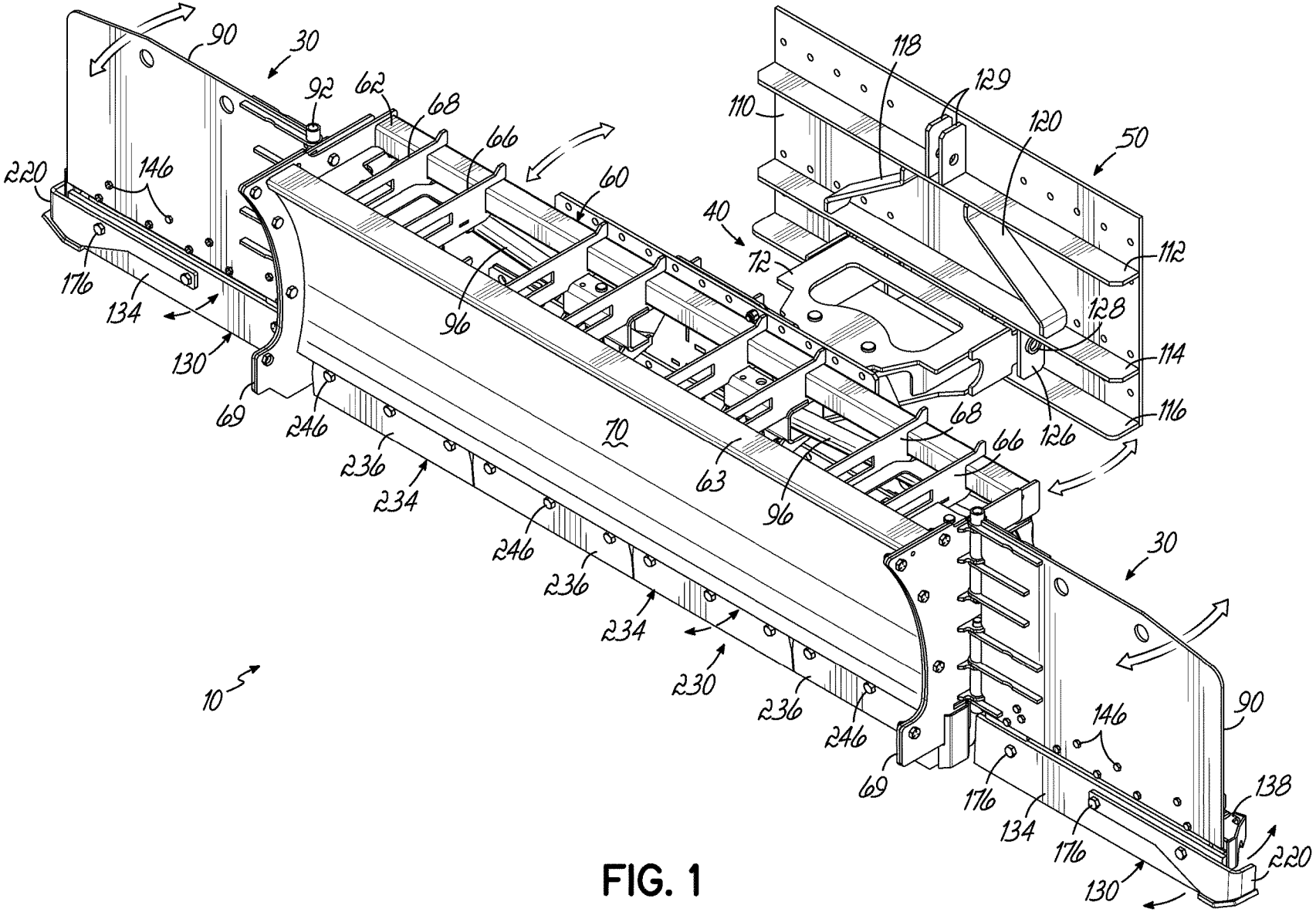
FIG. 1 is a front, left, top perspective of a plow according to the principles of the present invention.
Figure 2:
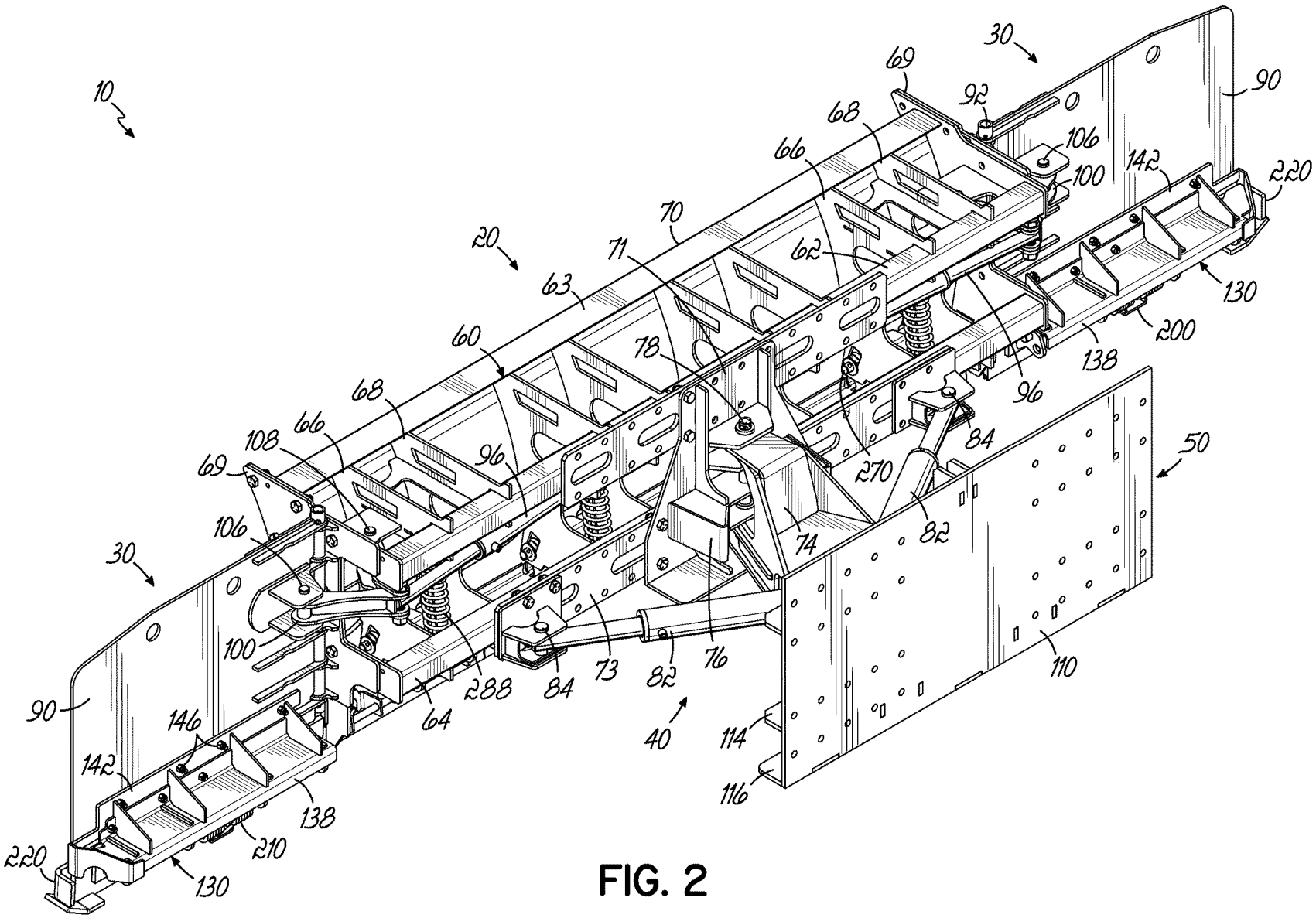
FIG. 2 is a rear, left, top perspective thereof.
Figure 3:
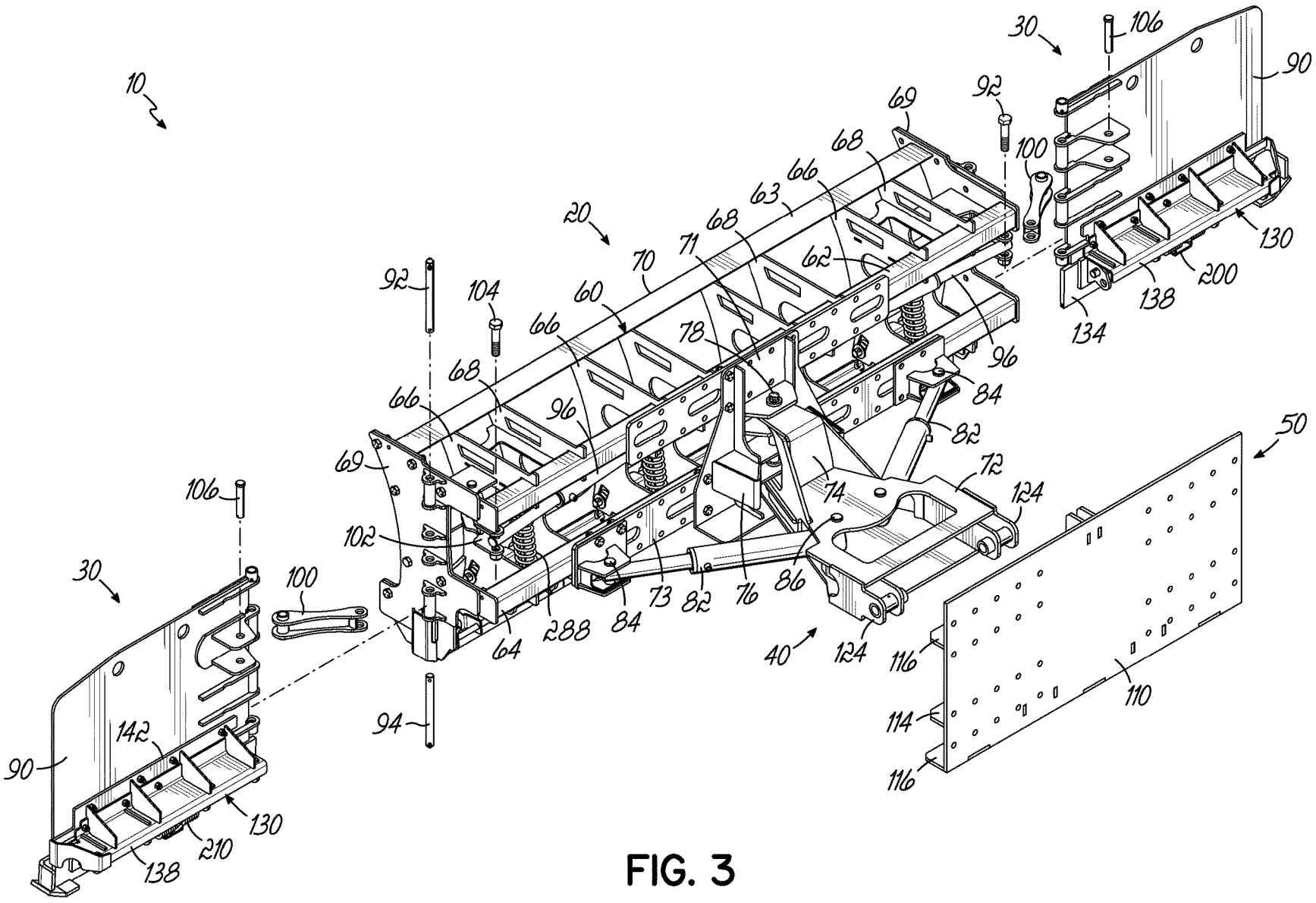
FIG. 3 is a rear, left, top, exploded perspective thereof.
Figure 4:
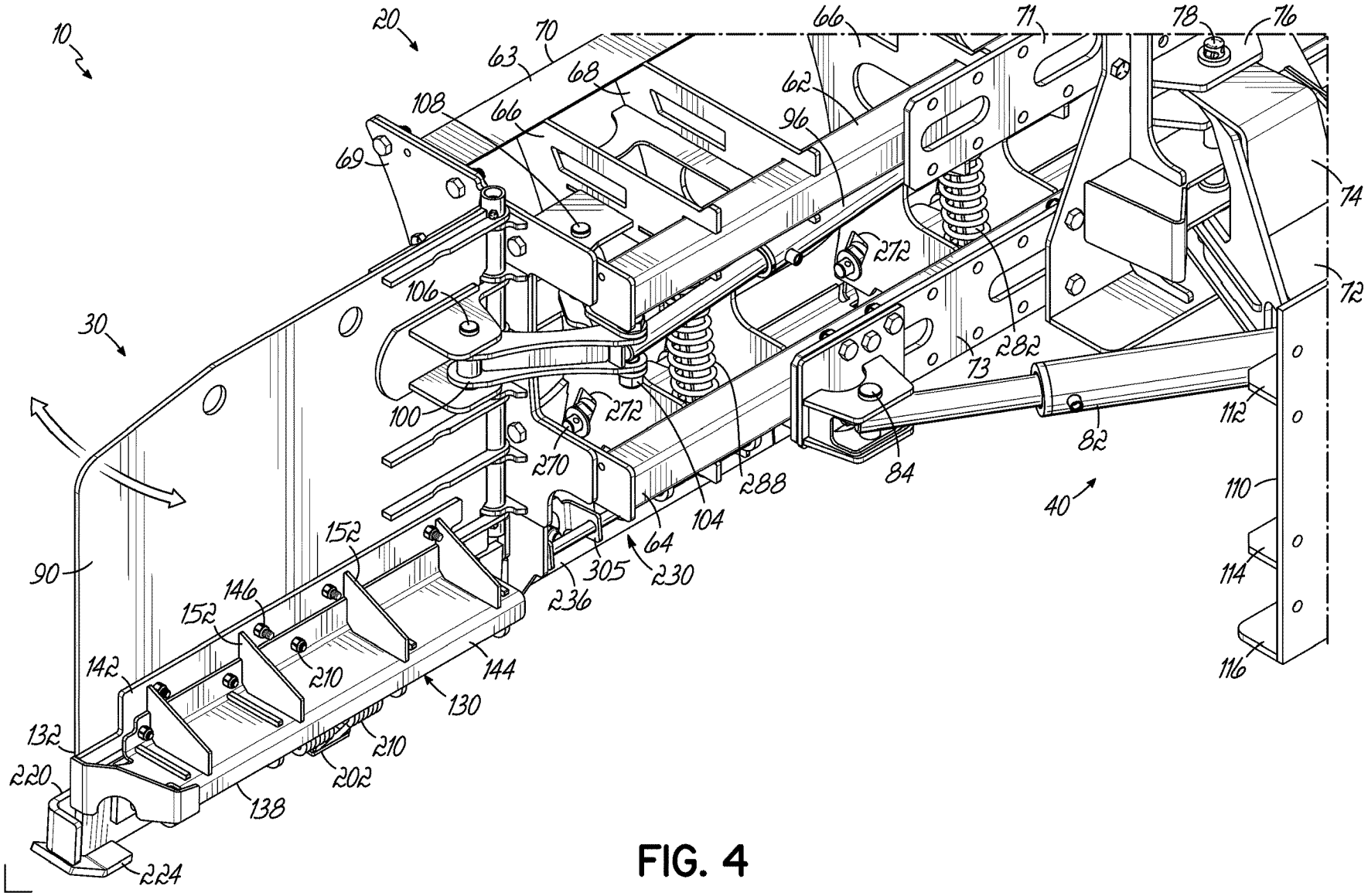
FIG. 4 is an enlarged, rear, left, top perspective view of the left hand end of the plow.
Figure 5:
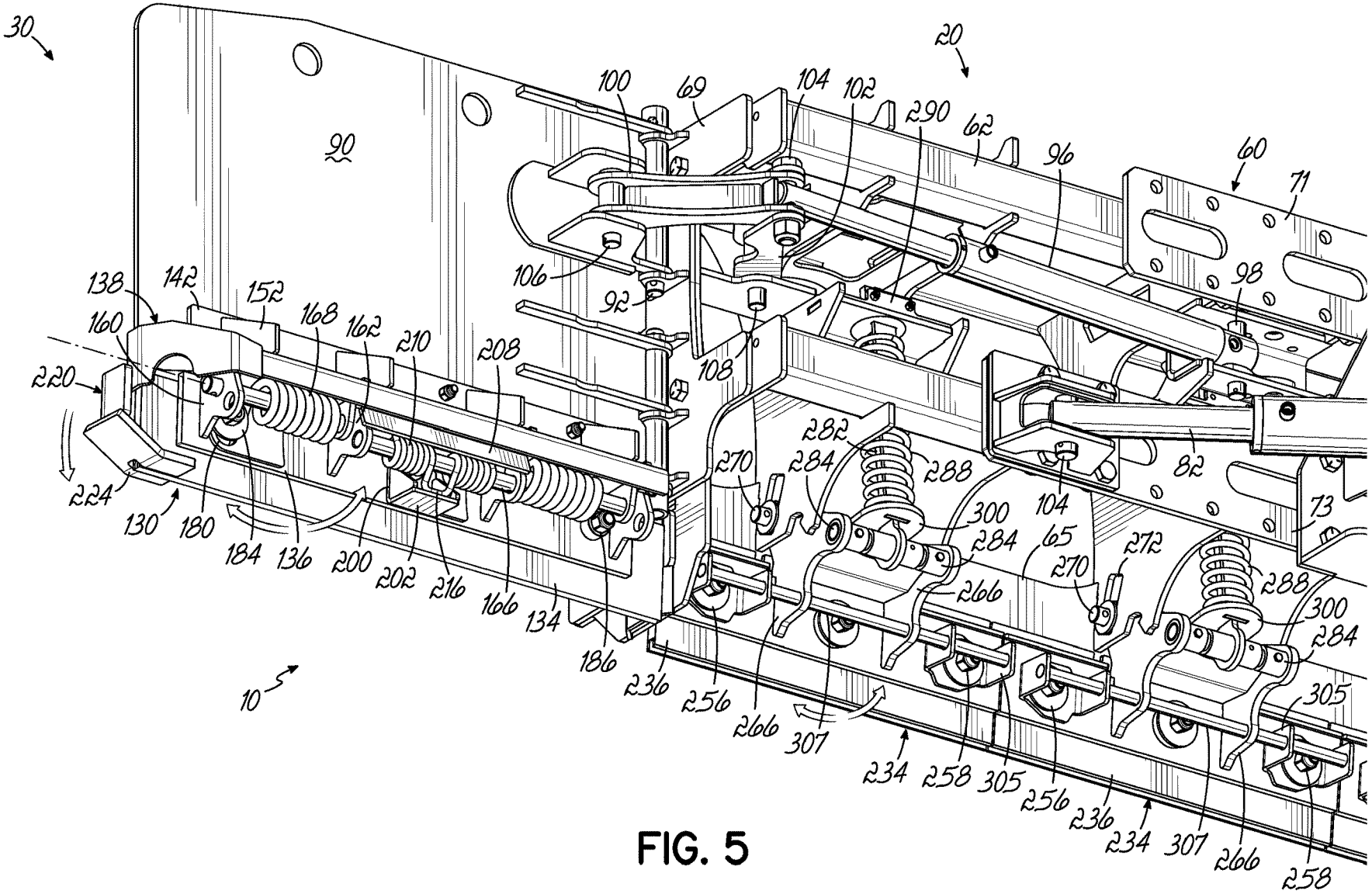
FIG. 5 is an enlarged, rear, left, bottom perspective view of the left hand end of the plow.
Figure 6:
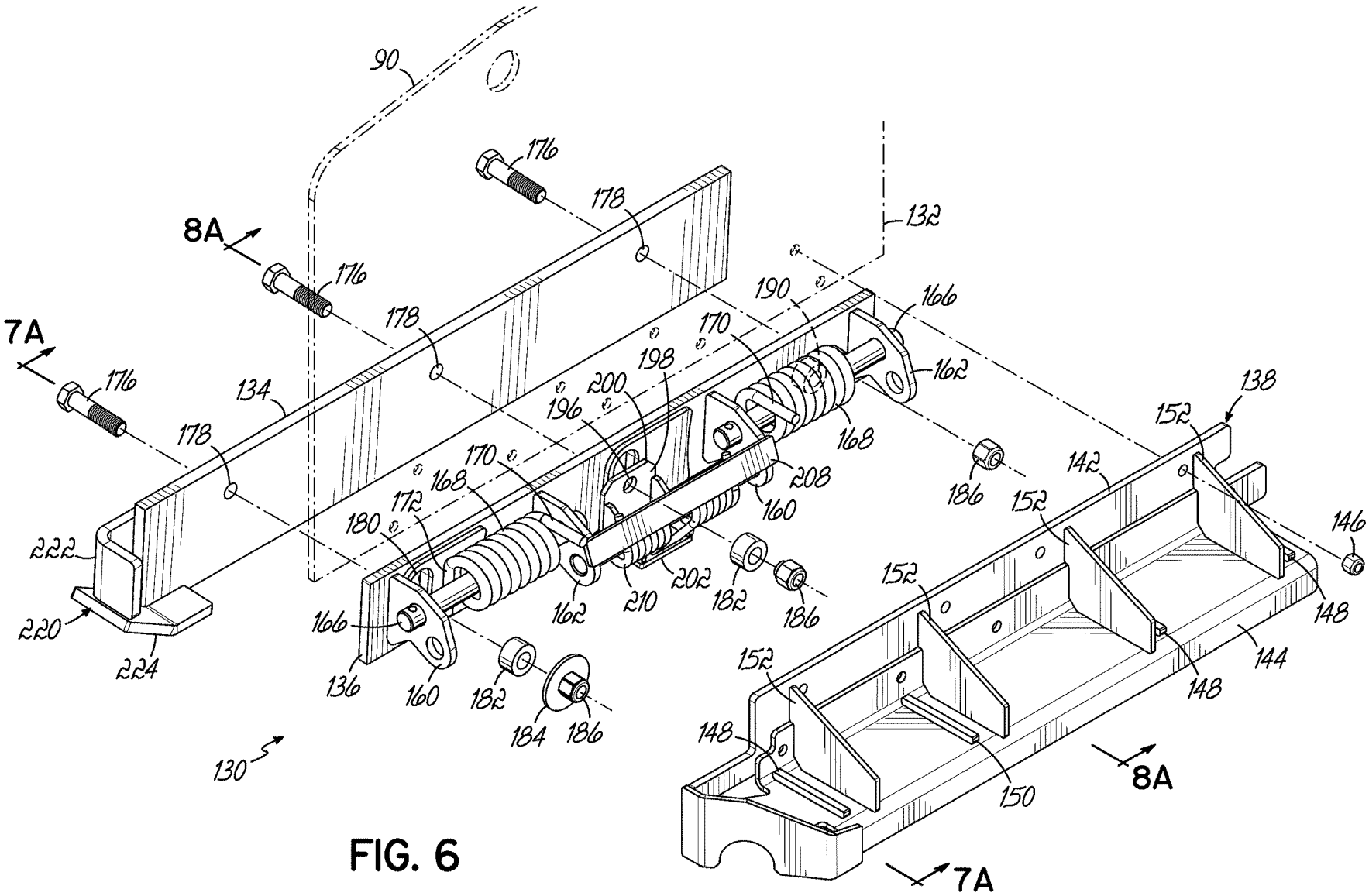
FIG. 6 is a rear, left, top, exploded perspective view of the left hand wing cutting edge.

Referring first to FIGS. 1-3, a plow assembly 10 according to the principles of the present invention is illustrated. Plow assembly 10 includes a main or central plow assembly 20, a pair of plow wing assemblies 30, a plow support frame assembly 40, and a plow mounting plate assembly 50. While the main or central plow assembly 20 is illustrated as being much wider than each plow wing assembly 30, it is to be understood that the plow assembly 10 can also be configured into essentially a V-blade plow wherein each wing assembly 30 is much wider than the main or central plow assembly 20.

The main or central plow assembly 20 includes a moldboard frame 60 having upper 62 and lower 64 generally transverse, generally horizontal frame members. A plurality of pairs of generally vertical ribs or plates 66, 68 are secured to frame members 62, 64. A pair of end plates 69 are likewise secured to frame members 62, 64. A top plate 63 and bottom plate 65 are secured to the ribs 66, 68. A moldboard 70 is secured to the ribs 66, 68, the end plates 69, and the top and bottom plates 63, 65.

The plow support frame assembly 40 includes a generally A-shaped frame 72 having a female clevis plate 74 at a forward end thereof. Moldboard frame 60 has upper and lower bolting plates 71, 73, each including an array of bolt holes, secured to upper 62 and lower 64 frame members, respectively. A cooperating male clevis plate 76 is bolted to the bolting plates 71, 75. A pivot pin 78 pivotally connects the clevis connection 74, 76 for pivoting movement of main or central plow assembly 20 relative to plow support frame assembly 40 about a generally vertical axis. A pair of hydraulic rams 82 have piston ends pivotally connected to lower bolting plate 73 at 84 and cylinder ends pivotally connected to A-frame 72 at 86. Rams 82 providing pivoting movement of main or central plow assembly 20 relative to plow support frame assembly about the generally vertical pivot axis. See FIG. 15D.

Figure 15A:
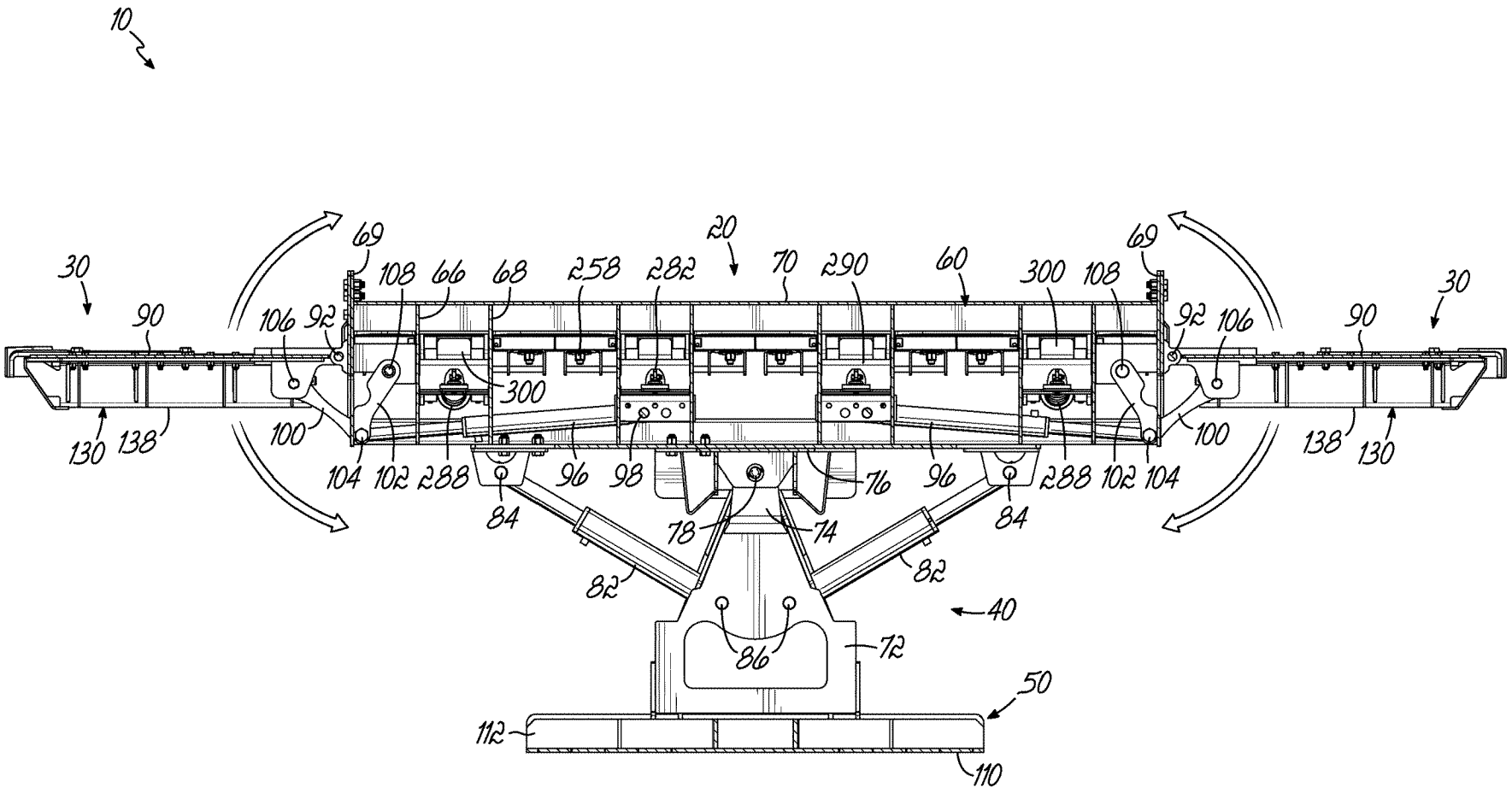
FIG. 15A is a top view of the plow with wings parallel to the moldboard.
Figure 15B:
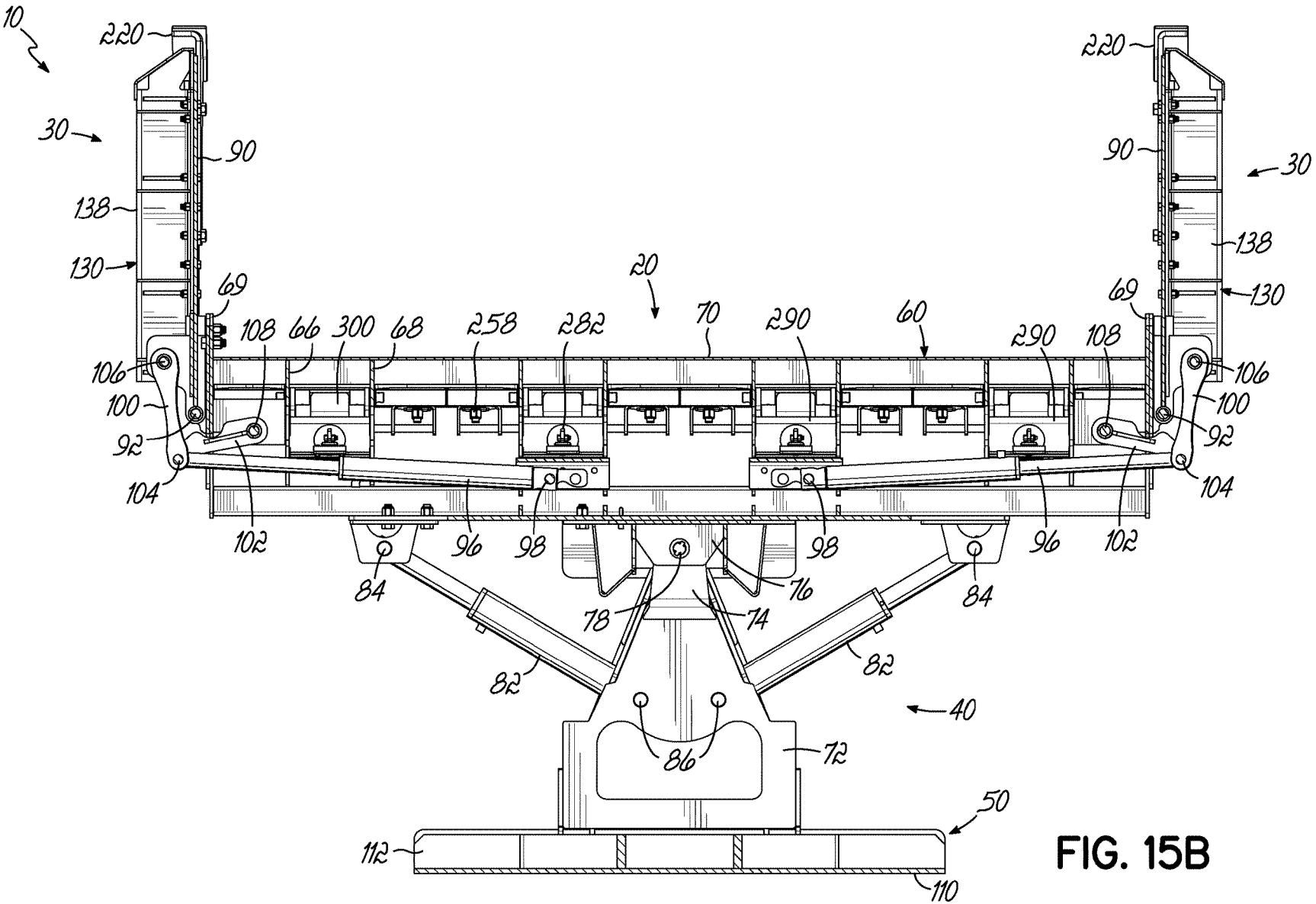
FIG. 15B is a top view of the plow with wings forward and perpendicular to the moldboard.
Figure 15C:
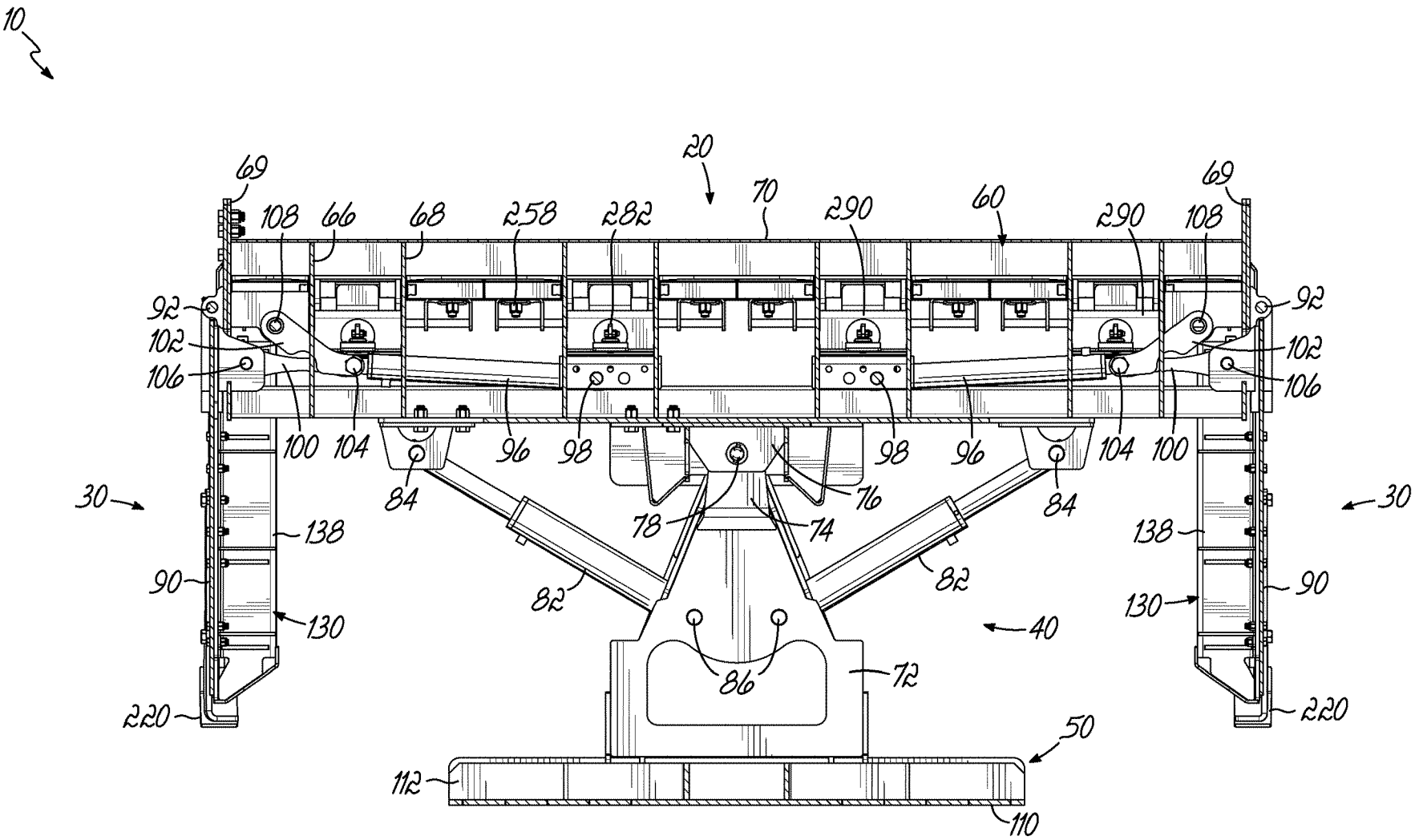
FIG. 15C is a top view of the plow with wings rearward and perpendicular to the moldboard.
Figure 15D:
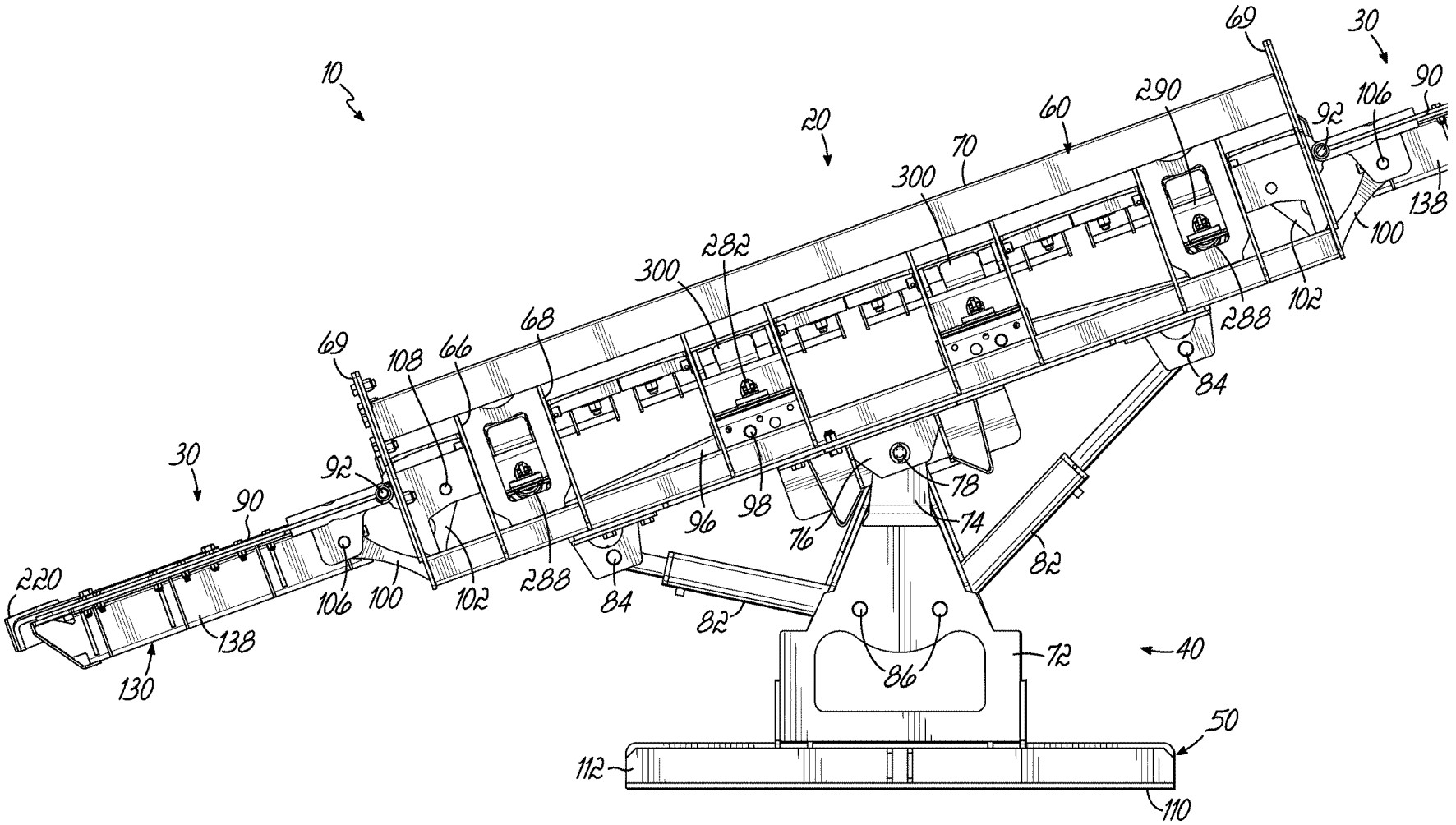
FIG. 15D is a top view of the plow with wings parallel to the moldboard and the moldboard angled to the left.

Referring to FIGS. 1-5 and 15A-15C, each plow wing assembly 30 includes a wing 90 pivotally connected to its respective moldboard frame end plate 69 with pins 92, 94. A hydraulic ram 96 has a cylinder end pivotally connected to the moldboard frame at 98. The piston end of ram 96 is pivotally connected to a pair of links 100, 102 at 104. Link 100 is pivotally connected to wing 90 at 106, and link 102 is pivotally connected to moldboard frame 60 at 108. Rams 96 providing pivoting movement of wings 90 relative to moldboard frame 60 so as to be positionable forward and perpendicular to the moldboard 70 (FIG. 15B), parallel to the moldboard 70 (FIG. 15A), and rearward and perpendicular to the moldboard 70 (FIG. 15C).

Plow mounting plate assembly 50 has a rectangular plate 110 with a plurality of transverse reinforcement plates 112, 114, 116 secured thereto. Diagonal interconnecting reinforcement plates 118, 120 interconnect plates 112, 114. Plates 114, 116 are spaced apart so as to closely receive therebetween the rearward ends 124 of A-frame 72. The rearward ends 124 of A-frame 72 can be secured to lower vertical plates 126 between transverse plates 114, 116 with fasteners 128 such as bolts and nuts, pins, or the like. Upper vertical plates 129 provide a third attachment point of plow support frame assembly 40 to plow mounting plate assembly 50. Rectangular plate 110 is adapted to be mounted to a skid steer loader, wheeled loader, or tractor in place of the customary bucket, as is known to those skilled in the art. Lift arms on the skid steer loader, wheeled loader, or tractor raise and lower rectangular plate 110 thus raising and lowering the entire plow assembly 10.

Alternatively, plow support frame assembly 40 and plow mounting plate assembly 50 can be done away with, and moldboard frame 60, via bolting plates 71, 73, can be mounted to the lift arms of the skid steer loader, wheeled loader, or tractor via a suitable intermediate adapter/mounting plate, which could include a slip hitch or the like.

Referring to FIGS. 4-9B, wing 90 includes a wing cutting edge assembly 130 mounted to a lower edge or edge region 132 of wing 90. Wing cutting edge assembly 130 includes a cutting edge 134, a cutting edge support plate 136, and a cutting edge support plate bracket 138. Bracket 138 is generally L-shaped in cross-section having a leg portion 142 and a foot portion 144. Leg portion 142 is secured to a rear surface of wing 90 with fasteners 146, for example bolts and nuts. Foot portion 144 has, depending therefrom, an outboard pair 148, 150 of pivot pin mounting ears and an inboard pair 148, 150 of pivot pin mounting ears. Gusset plates 152 interconnect the leg and foot portions 142, 144.

Support plate 136 has, extending rearward therefrom, an outboard pair 160, 162 of pivot pin mounting ears and an inboard pair 160, 162 of pivot pin mounting ears. Each support plate ear pair 160, 162 and corresponding bracket ear pair 148, 150 are pivotally connected via a pivot pin 166. A torsion spring 168 encircles each pin 166. Each torsion spring 168 has a one leg 170 engaging an underneath surface of foot portion 144 of bracket 138 and another leg 172 engaging a rearward surface of support plate 136. Support plate 136 and hence cutting edge 134 are thus pivotally connected to bracket 138 and hence wing 90 for pivoting movement about an axis generally parallel to the lower edge or edge region 132 of wing 90 (i.e., a generally horizontal, generally transverse axis (transverse to longitudinal axis of vehicle) when wing 90 is positioned parallel to moldboard 70 and moldboard 70 is positioned facing forward as shown in FIG. 15A), as well as being biased forward relative to the lower edge or edge region 132 of wing 90. Wing cutting edge assembly 130 is preferably configured to permit about 42.7 degrees of rearward pivoting movement of wing cutting edge 134.

Cutting edge 134 is secured to support plate 136 with three fasteners 176, for example bolts. The outboard most bolt 176 passes through a hole 178 in the cutting edge 134 and through a generally vertical slot 180 in the support plate 136, i.e. the longitudinal axis of slot 180 is generally perpendicular the longitudinal axis of support plate 136. This bolt 176 passes through a bushing 182 positioned in slot 180 and through a washer 184 positioned against a rearward surface of the support plate 136. A nut 186 on this bolt 176 secures the cutting edge 134, support plate 136, bushing 182, and washer 174 together.

The inboard most bolt 176 passes through a hole 178 in the cutting edge 134 and through a hole 190 in the support plate 136. A nut 186 on this bolt 176 secures the cutting edge 134 and support plate 136 together.

The third bolt 176 is positioned medially of the outboard most and inboard most bolts 176 and passes through a hole 178 in the cutting edge 134 and through a generally vertical slot 194 in the support plate 136, i.e. the longitudinal axis of slot 194 is generally perpendicular the longitudinal axis of support plate 136. This bolt 176 passes through a bushing 182 positioned in slot 194 and through a hole 196 in a leg portion 198 of an L-shaped bracket 200. A nut 186 on this bolt 176 secures the cutting edge 134, support plate 136, bushing 182, and L-shaped bracket 200 together.

L-shaped bracket 200 has a foot portion 202 extending rearward from leg portion 198. The outboard most one of the ears 162 on support plate 136 and the inboard most one of the ears 160 on the support plate 136 support a pin or rod 206. A bar 208 spans between and is secured to these ears. A torsion spring 210 encircles pin 206. The torsion spring 210 has two end legs 214 engaging a forward surface of bar 208 and a central U-shaped leg 216 engaging an upper surface of foot portion 202 of bracket 200. Cutting edge 134 is thus pivotally connected to support plate 136 and hence wing 90 for pivoting movement about an axis generally perpendicular to the lower edge or edge region 132 of wing 90 (i.e., a generally horizontal, generally longitudinal axis (parallel to longitudinal axis of vehicle) when wing 90 is positioned parallel to moldboard 70 and moldboard 70 is positioned facing forward as shown in FIG. 15A), as well as being biased about this axis so as to bias the outboard most end of the cutting edge 134 downward relative to the lower edge or edge region 132 of wing 90. Slots 180 and 194 can have a slight curvature to them to aid in the pivoting movement of cutting edge 134. Slots 180, 194 are preferably sized to permit about +/−1.93 degrees of pivoting movement of cutting edge 134.

Figure 7B:
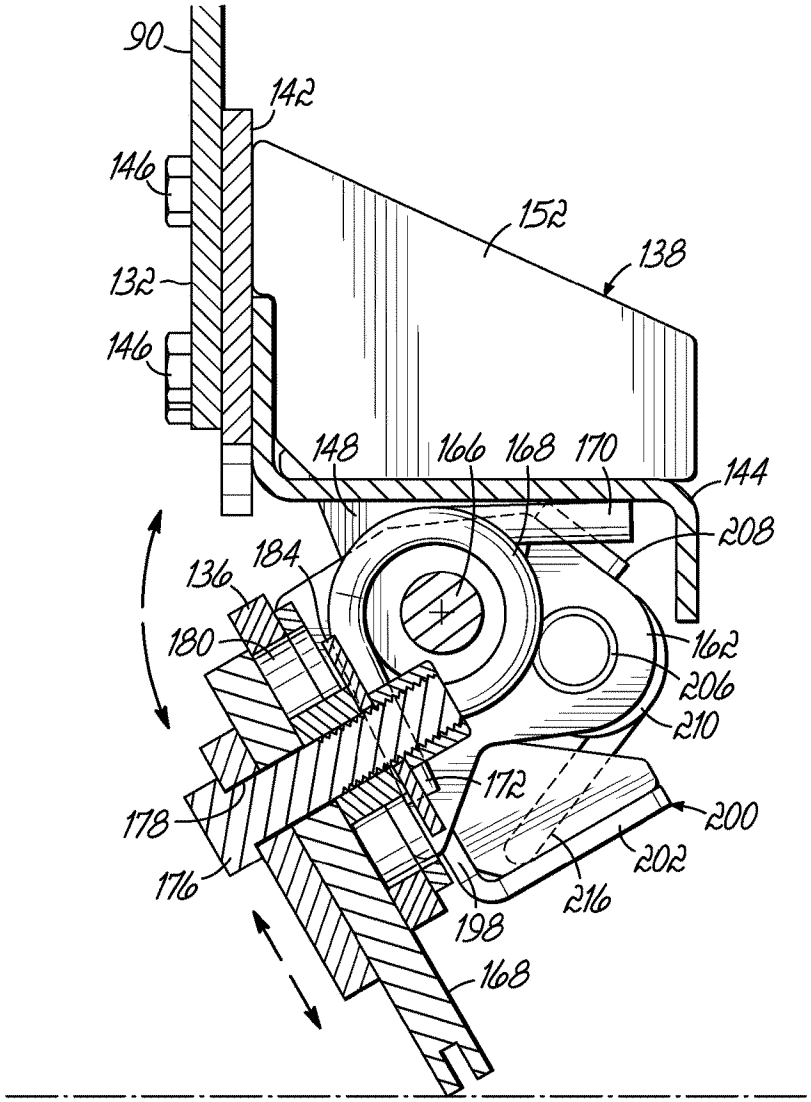
FIG. 7B is a view similar to FIG. 7A illustrating the wing cutting edge pivoted rearward.
Figure 7A:
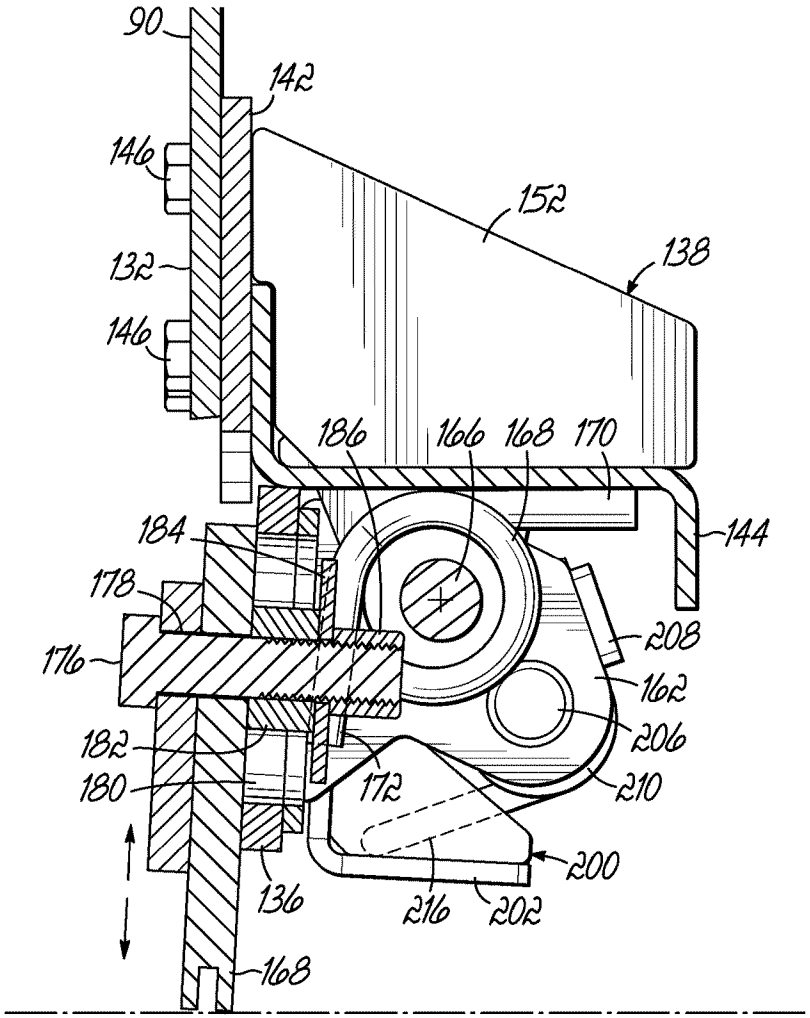
FIG. 7A is a cross-sectional view taken along line 7A-7A in FIG. 6 illustrating the wing cutting edge in a neutral position.

FIG. 7A illustrates the cutting edge 134 in the neutral position.

In FIG. 7B, the cutting edge 134 has been pivoted rearward against the bias of the torsion springs 168, as when encountering a surface obstruction.

Figure 8B:
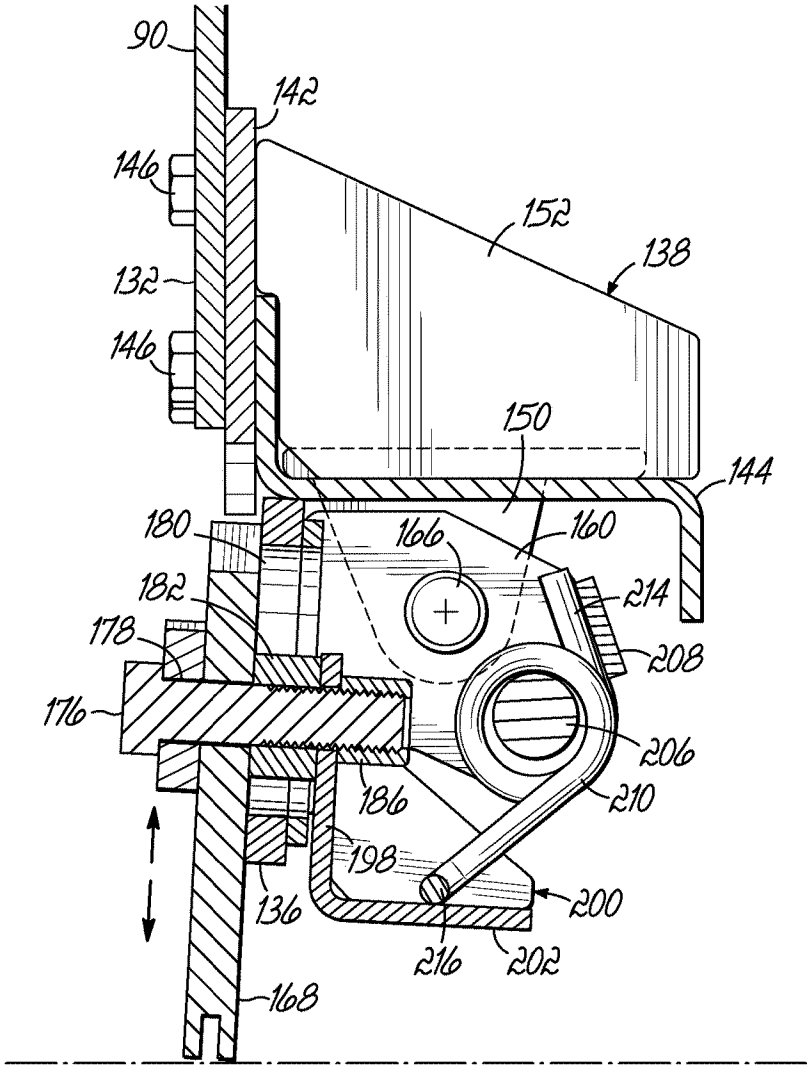
FIG. 8B is a view similar to FIG. 8A illustrating the wing cutting edge furthest from the pivot connection of the wing to the moldboard frame pivoted downward.
Figure 8A:
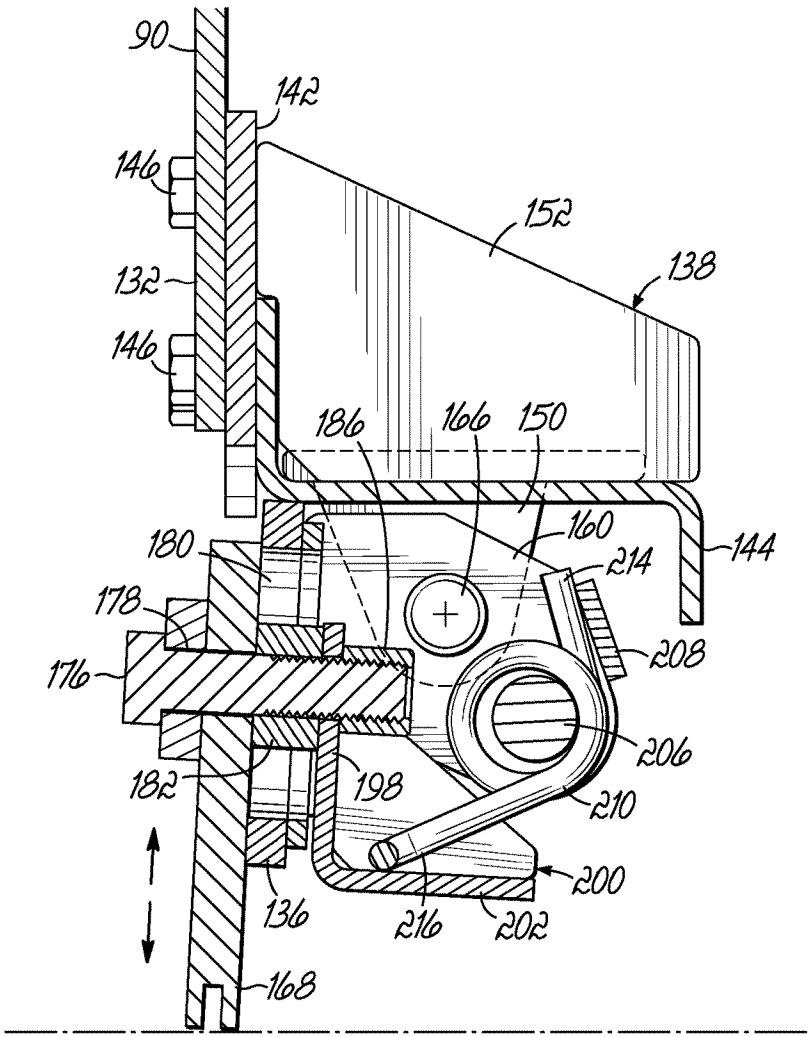
FIG. 8A is a cross-sectional view taken along line 8A-8A in FIG. 6 illustrating the wing cutting edge in a neutral position.

FIG. 8A also illustrates the cutting edge 134 in the neutral position.

In FIG. 8B, the bias of torsion spring 210 has caused pivoting of cutting edge 134 such that the outboard most end of the cutting edge 134 has moved downward, as when encountering a surface irregularity such as a depression.

Figure 9A:
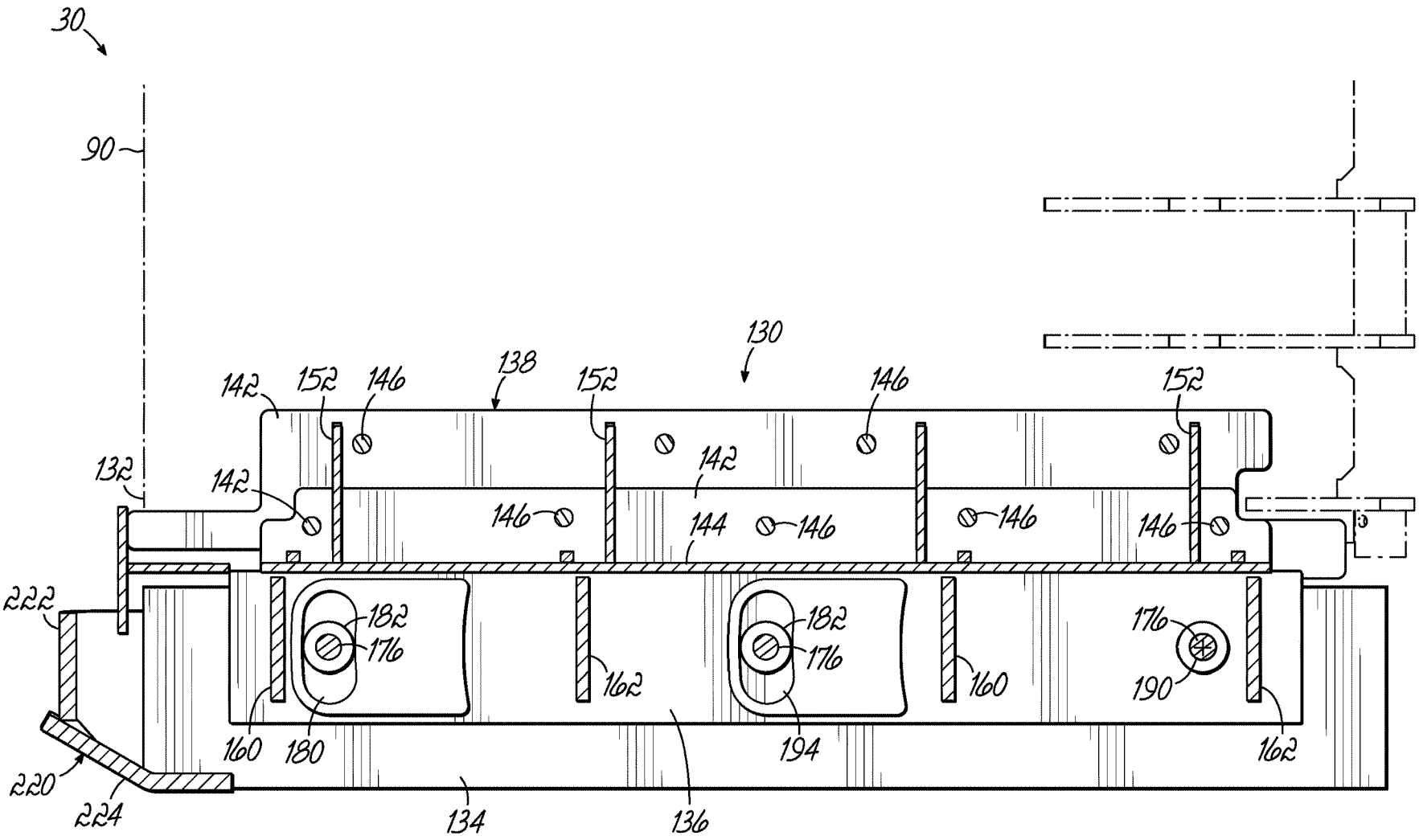
FIG. 9A is a rear view of the left hand wing cutting edge in the neutral position.

FIG. 9A also illustrates the cutting edge 134 in the neutral position.

Figure 9B:
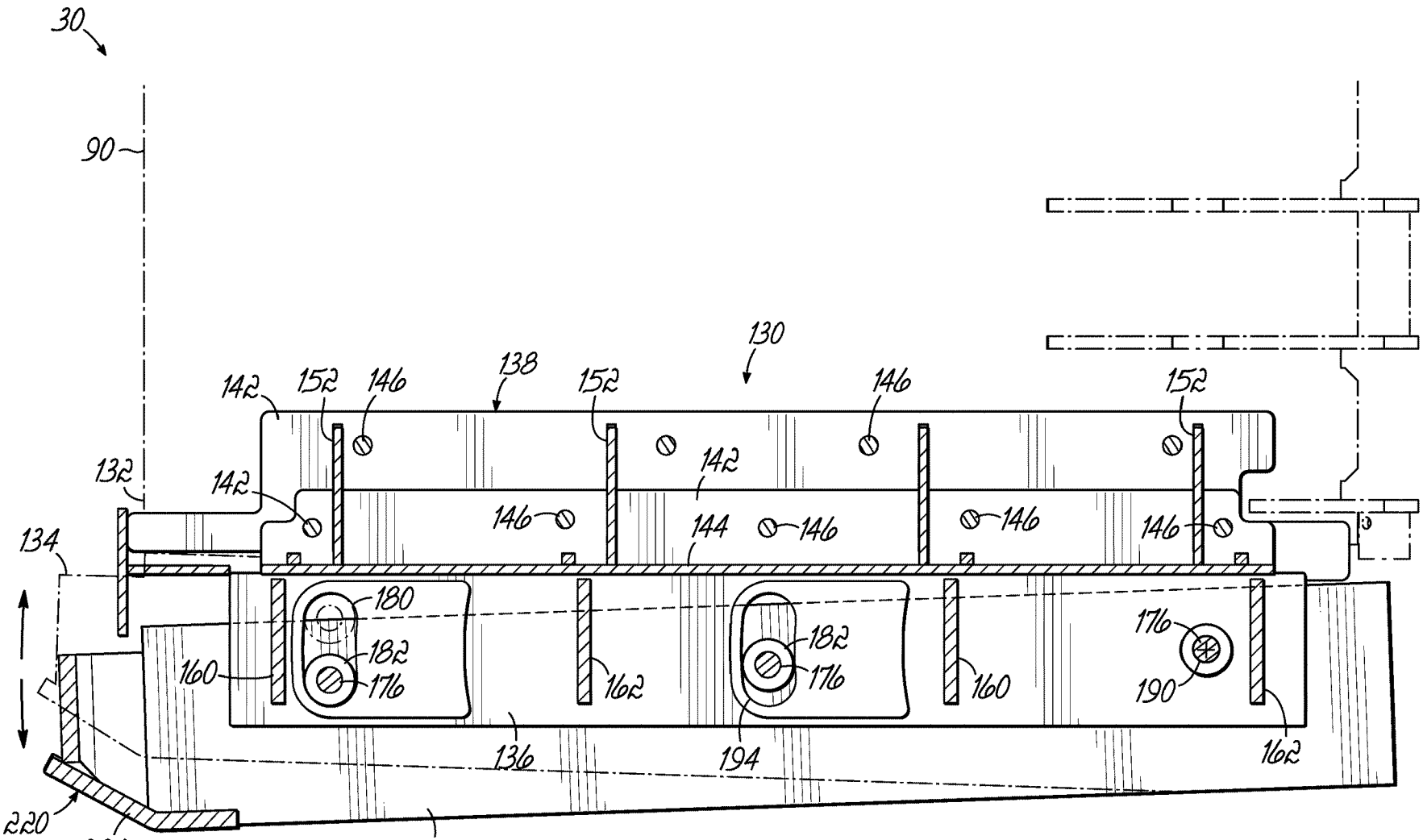
FIG. 9B is a view similar to FIG. 9A illustrating the wing cutting edge furthest from the pivot connection of the wing to the moldboard frame pivoted downward.

In FIG. 9B, the bias of torsion spring 210 has caused pivoting of cutting edge 134 such that the outboard most end of the cutting edge 134 has moved downward, as when encountering a surface irregularity such as a depression.

In order to assist pivoting of the cutting edge 134 about the pivot axis provided by pin 166 and the pivot axis provided by inboard most bolt 176, a shoe 220 is secured to a forward surface of cutting edge 134 with the two outboard most bolts 176. Shoe 220 has a rearward turned portion 222 and an upturned portion 224. These portions 222, 224 assist in such pivoting when encountering surface obstructions and surface irregularities.

Figure 10:
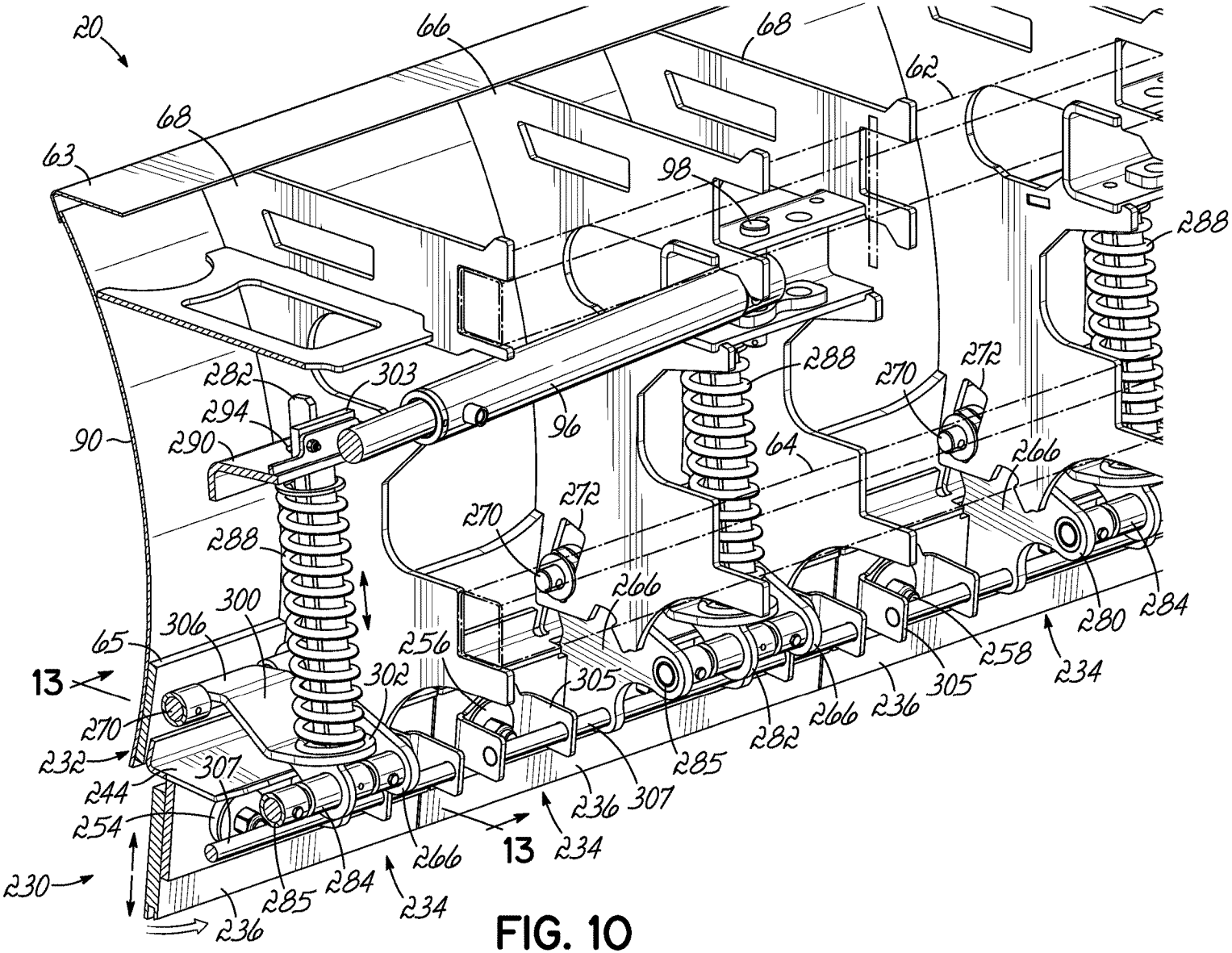
FIG. 10 is a rear, left, top perspective view in cross-section taken just inboard of the pivot connection of the left hand wing to the moldboard frame.
Figure 11:
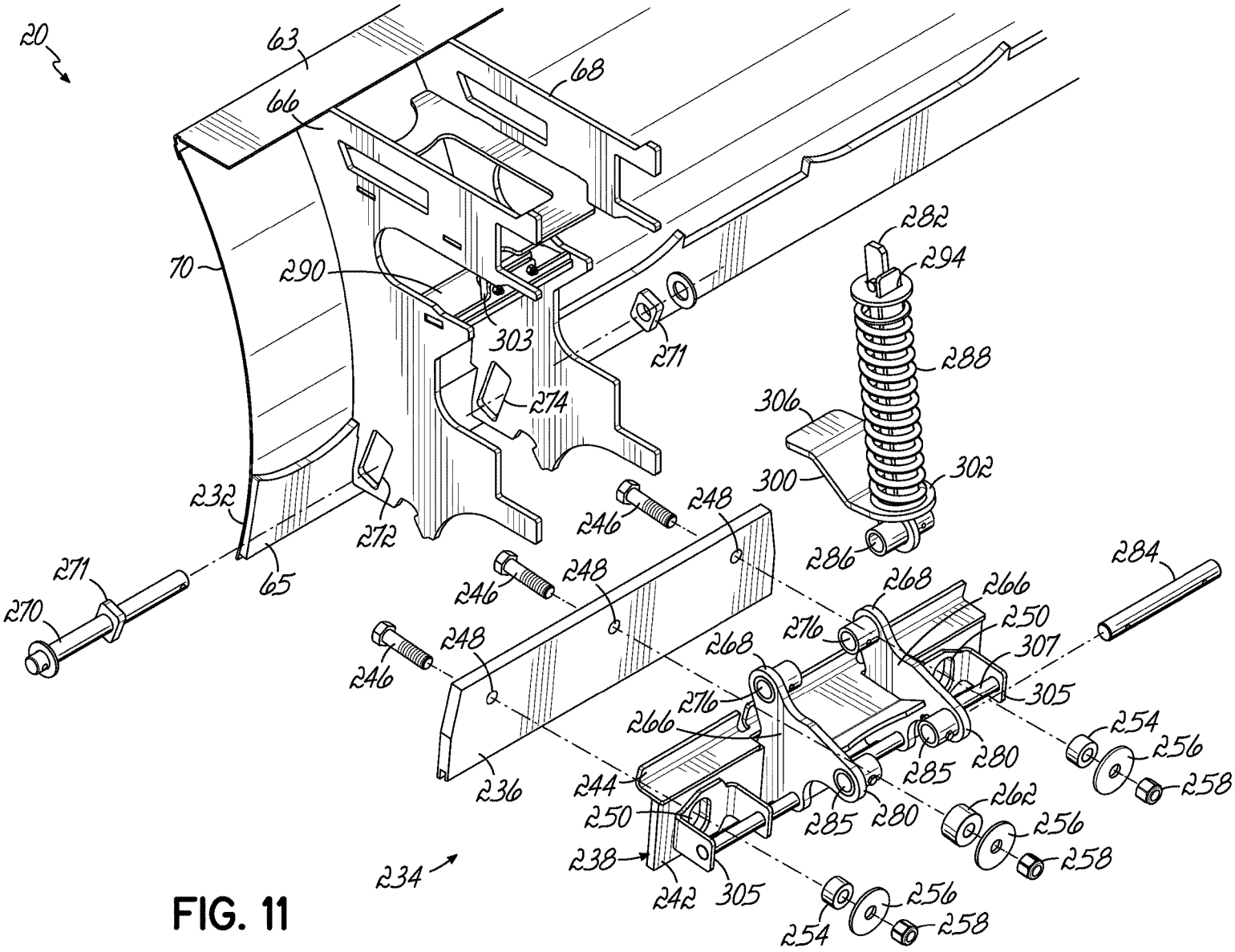
FIG. 11 is a rear, left, top, exploded perspective view of a moldboard cutting edge segment.
Figure 12:
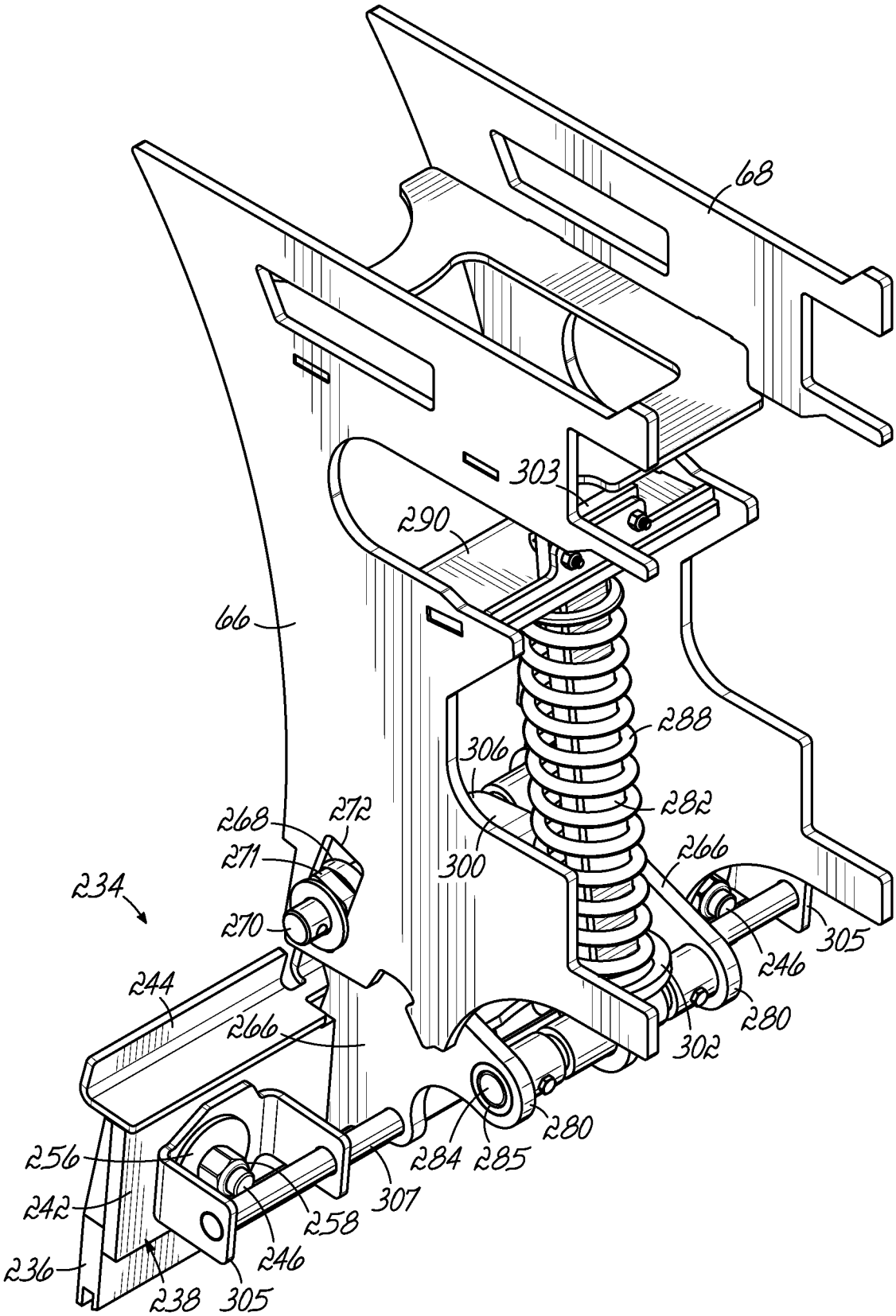
FIG. 12 is a view similar to FIG. 11 in assembled form.

Referring to FIGS. 10-12, moldboard 70 includes a moldboard cutting edge assembly 230 mounted to a lower edge or edge region 232 of moldboard 70. Assembly 230 is made up of a plurality of moldboard cutting edge segment subassemblies 234. Each subassembly 234 includes a cutting edge segment 236 and a cutting edge segment support plate 238, and is mounted to each rib pair 66, 68.

Support plate 238 is generally L-shaped in cross-section having a leg portion 242 and a foot portion 244. Cutting edge segment 236 is secured to leg portion 242 of support plate 238 with three fasteners 246, for example bolts. The bolts 246 adjacent the ends of the cutting edge segment 236 pass through holes 248 in the segment 236 and through generally vertical slots 250 in the leg portion 242 of the support plate 238, i.e. the longitudinal axes of slots 250 are generally perpendicular the longitudinal axis of support plate 238. These bolts 246 pass through bushings 254 positioned in slots 250 and through washers 256 positioned against a rearward surface of the leg portion 242 of support plate 238. Nuts 258 on these bolts 246 secured the cutting edge segment 236, support plate 238, bushings 254, and washers 256 together.

The third bolt 246 passes through a hole 248 located medially of the length of the cutting edge segment 236, through a hole 260 in the leg portion 242 of the support plate 238, through a bushing 262 positioned in hole 260, and through washer 256. A nut 258 on this bolt 246 secures the cutting edge segment 236, support plate 238, bushing 262, and washer 256 together. Cutting edge segment 236 is thus freely pivotally connected to support plate 238 and hence moldboard 70 for pivoting movement about an axis generally perpendicular to the lower edge or edge region 232 of moldboard 70 (i.e., a generally horizontal, generally longitudinal axis (parallel to longitudinal axis of vehicle) when moldboard 70 is positioned facing forward as shown in FIG. 15A). Slots 250 can have a slight curvature to them to aid in the pivoting movement of cutting edge segment 236. Each cutting edge segment 236 is preferably about two feet long, and slots 250 are preferably sized to permit about +/−5 degrees of pivoting movement of cutting edge segment 236.

Support plate 238 includes a pair of plates 266 secured to leg portion 242 and foot portion 244 forming a pivot link. Upper forward ends 268 of plates 266 are pivotally connected to rib pair 66, 68 of moldboard frame 60 by a pivot pin 270 passing through slots 272, 274 in ribs 66, 68, respectively, and through holes 276 in upper forward ends 268. Pin 270 carries a guide element 271 on each end. Guide elements 271 ride in slots 272, 274. Slots 272, 274 are oriented such that their longitudinal axes are generally, or roughly, parallel to the lower edge or edge region 232 of moldboard 70. With main or central plow assembly 20 lowered to a resting position on pavement, lower edge or edge region 232 of moldboard 70 is preferably about 6 degrees from vertical, and the longitudinal axes of slots 272, 274 are preferably about 14 degrees from lower edge or edge region 232. Accordingly, as used herein, "generally, or roughly, parallel to the lower edge or edge region 232 of moldboard 70" is deemed to embrace angular values of between about 0 degrees (parallel) and about 14 degrees (deviation from parallel) of the longitudinal axes of slots 272, 274 relative to the lower edge or edge region 232 of moldboard 70. Support plate 238 and hence cutting edge segment 236 are thus pivotally connected to moldboard frame 60 for pivoting movement about an axis generally parallel to the lower edge or edge region 232 of moldboard 70 (i.e., a generally horizontal, generally transverse axis (transverse to longitudinal axis of vehicle) when moldboard 70 is positioned facing forward as shown in FIG. 15A), as well as mounted for upward/downward translational movement, which movement is generally, or roughly, parallel to the lower edge or edge region 232 of moldboard 70. Slots 272, 274 are preferably sized to permit about +/−1.5 inches of vertical travel of cutting edge segment 236. Moldboard cutting edge segment subassembly 234 is preferably configured to permit about 40 degrees of rearward pivoting movement of cutting edge segment 236.

Lower rearward ends 280 of plates 266 are pivotally connected to a link 282 by a pivot pin 284 passing through holes 285 in ends 280 and hole 286 in lower end of link 282. A compression spring 288 encircles link 282. A plate 290 interconnects ribs 66, 68 and has an opening 294 therein. An upper end of spring 288 is captured against an underneath surface of plate 290 whilst an upper end of link 282 is free to slide upwardly and downwardly in opening 294 in plate 290. The lower end of spring 288 rests upon a plate 300 having a lower rearward end 302 with an opening 304 therein through which link 282 passes and an upper forward end 306 which rests upon pivot pin 270 when the moldboard cutting edge segment subassembly 234 is in the neutral position. Plate 300 overlies and is secured to a forward projecting leg 301 of link 282. To reduce friction during travel of link 282 upwardly and downwardly, a block 303 of UHMW is secured just forward of a rear edge of opening 294 for link 282 to ride against. Compression spring 288 serves to both bias the cutting edge segment 236 forward relative to the lower edge or edge region 232 of moldboard 70 about the pivot axis generally parallel to the lower edge or edge region 232 of moldboard 70 as well as bias the cutting edge segment 236 downward relative to the lower edge or edge region 232 of moldboard 70.

A U-shaped bracket 305 is secured to a rear surface of each end of support plate 238. Brackets 305 act as a wear pad for bushings 254. A rod 307 passes through holes in the legs of U-shaped brackets 305 and through holes in link plates 266 and provides rigidity to the support plate 238.

Figure 13A:
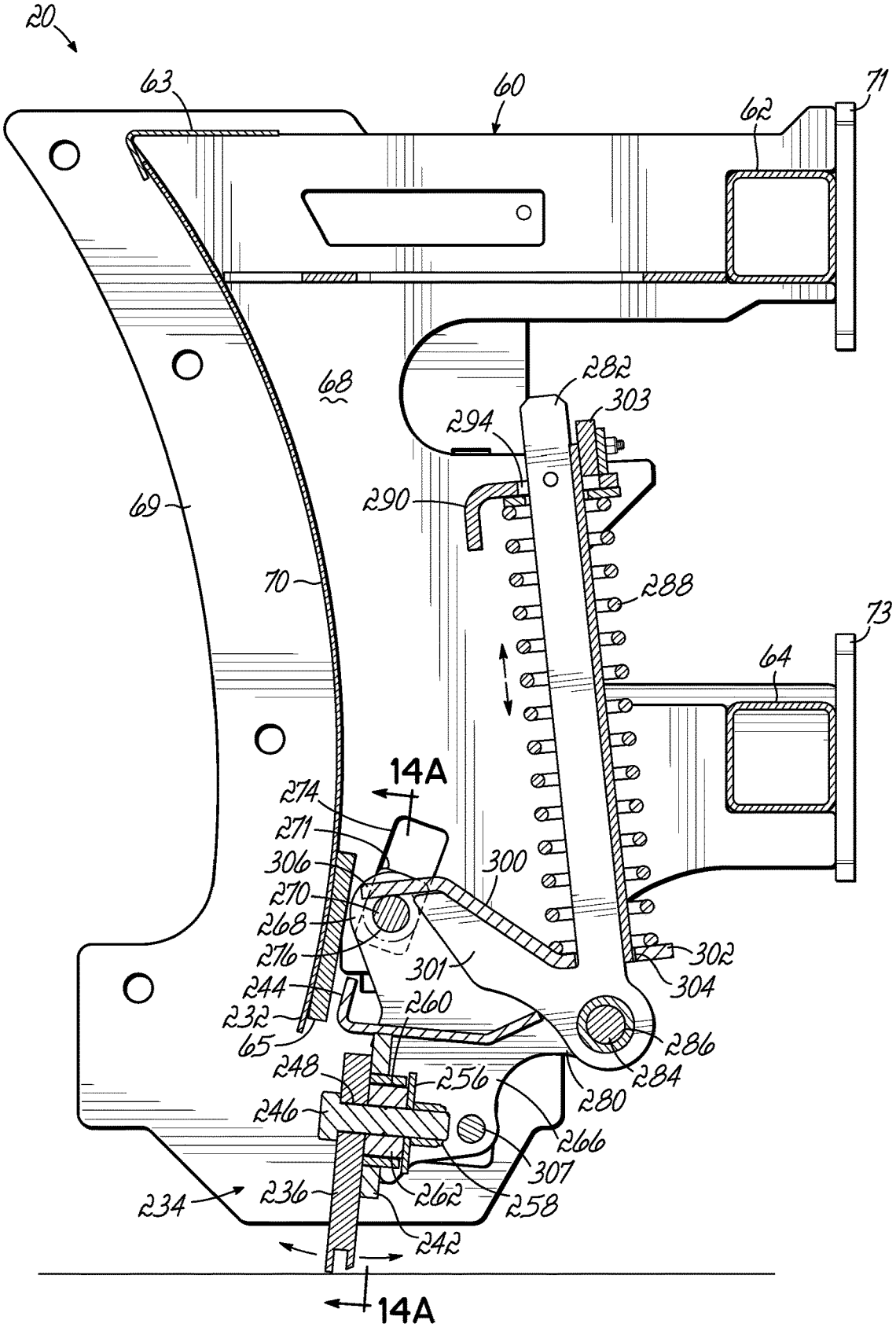
FIG. 13A is a view taken along line 13A-13A in FIG. 10 illustrating the moldboard cutting edge segment in neutral position.

FIG. 13A illustrates the cutting edge segment 236 in the neutral position.

Figure 13B:
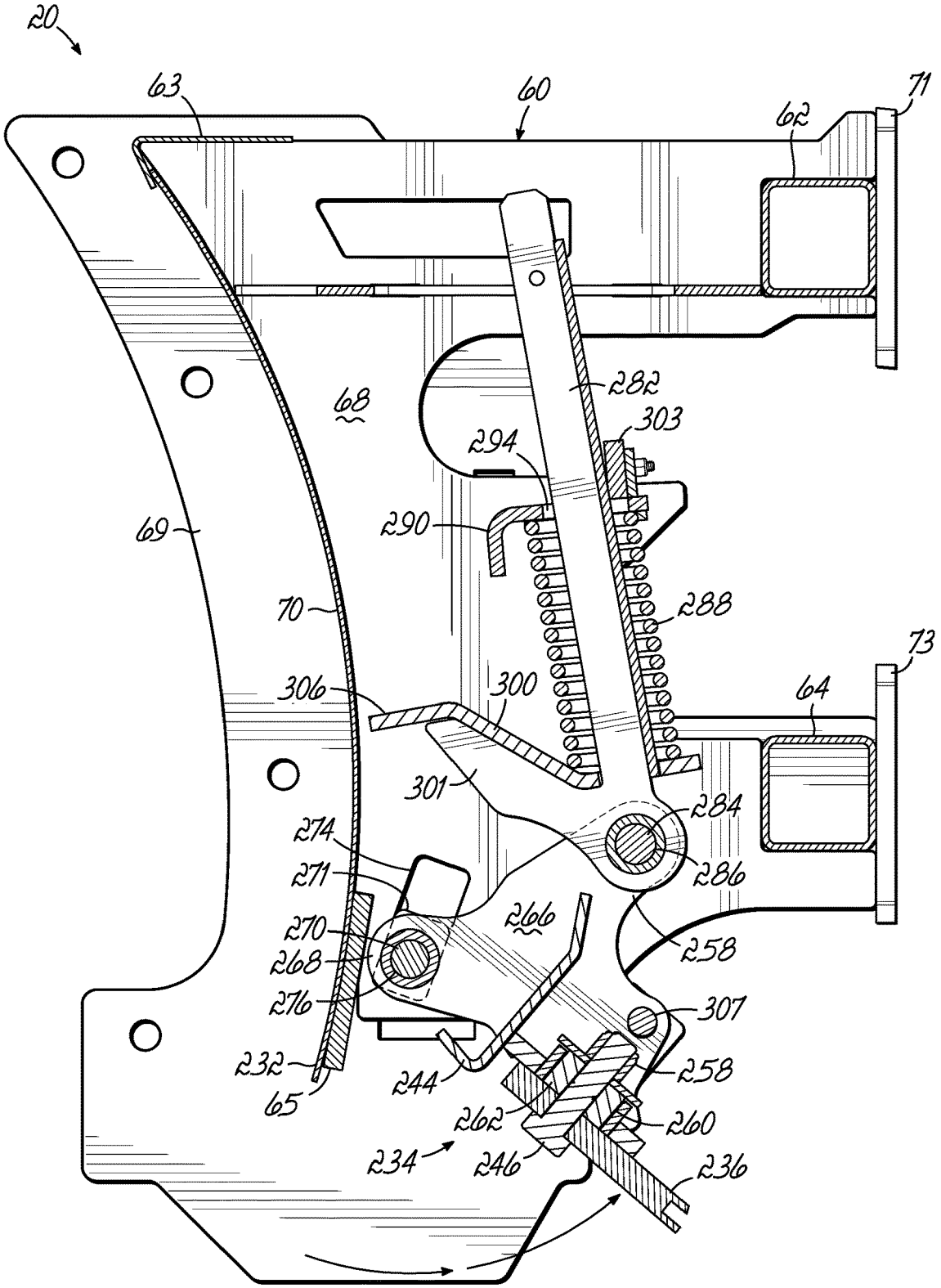
FIG. 13B is a view similar to FIG. 13A illustrating the moldboard cutting edge segment pivoted rearward.

In FIG. 13B, the cutting edge segment 236 has been pivoted rearward against the bias of the compression spring 288, as when encountering a surface obstruction.

Figure 13C:
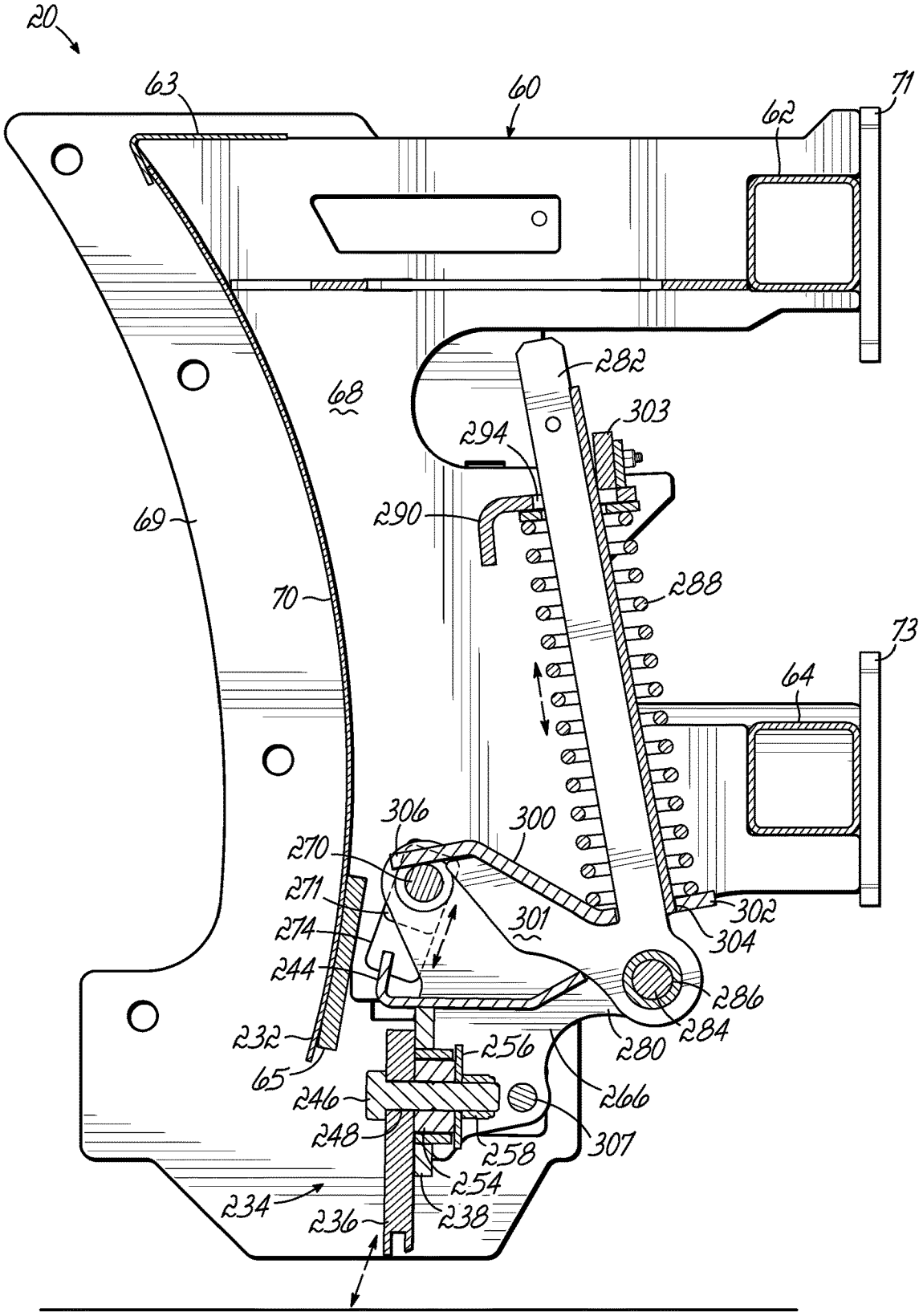
FIG. 13C is a view similar to FIG. 13B but illustrating the moldboard cutting edge segment translated upward.

In FIG. 13C, cutting edge segment 236 has been translated upwardly against the bias of compression spring 288, as when encountering a surface irregularity such as a rise.

Figure 14A:
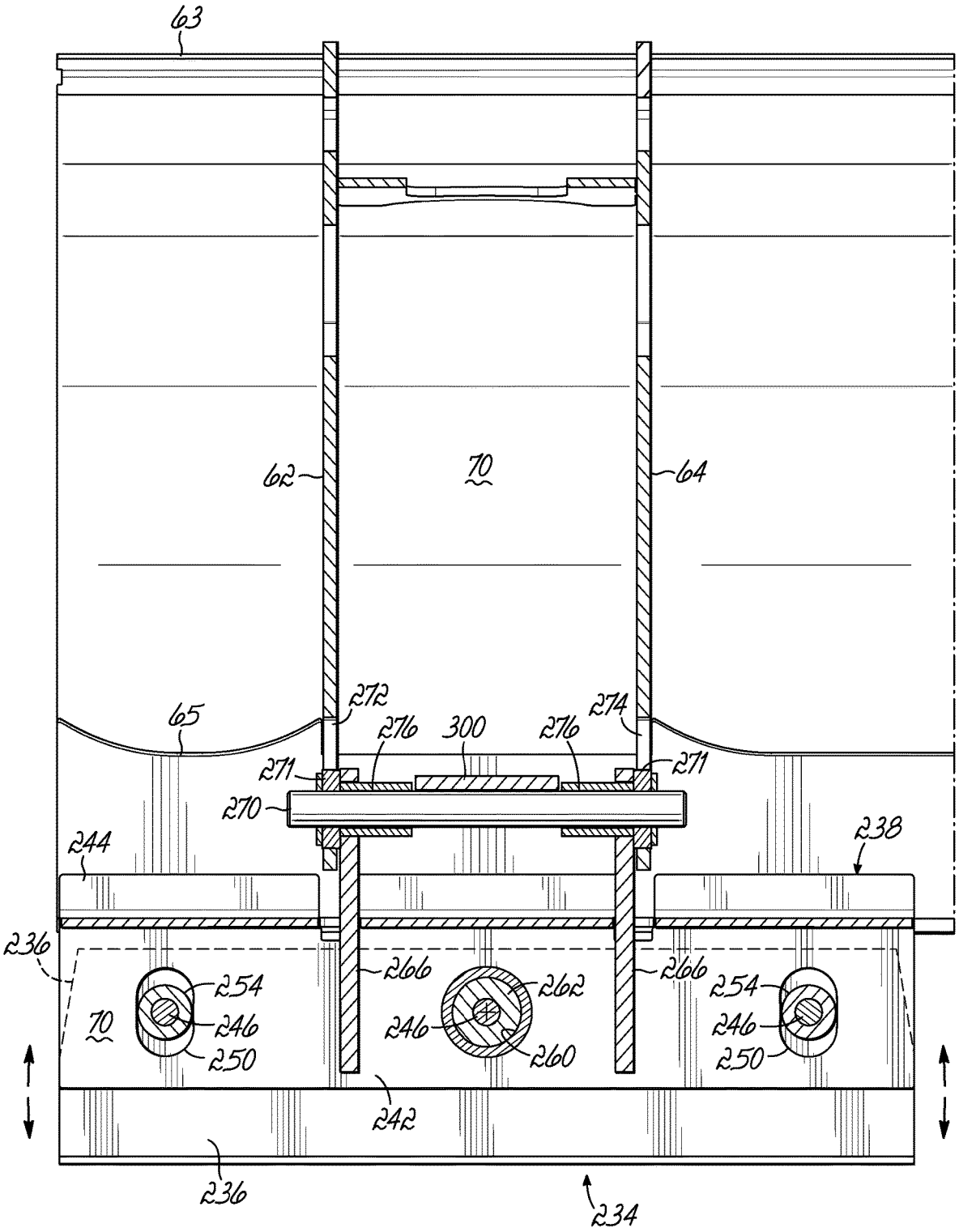
FIG. 14A is a view taken along line 14A-14A in FIG. 13A illustrating the moldboard cutting edge segment in the neutral position.

FIG. 14A also illustrates the cutting edge segment 236 in the neutral position.

Figure 14B:
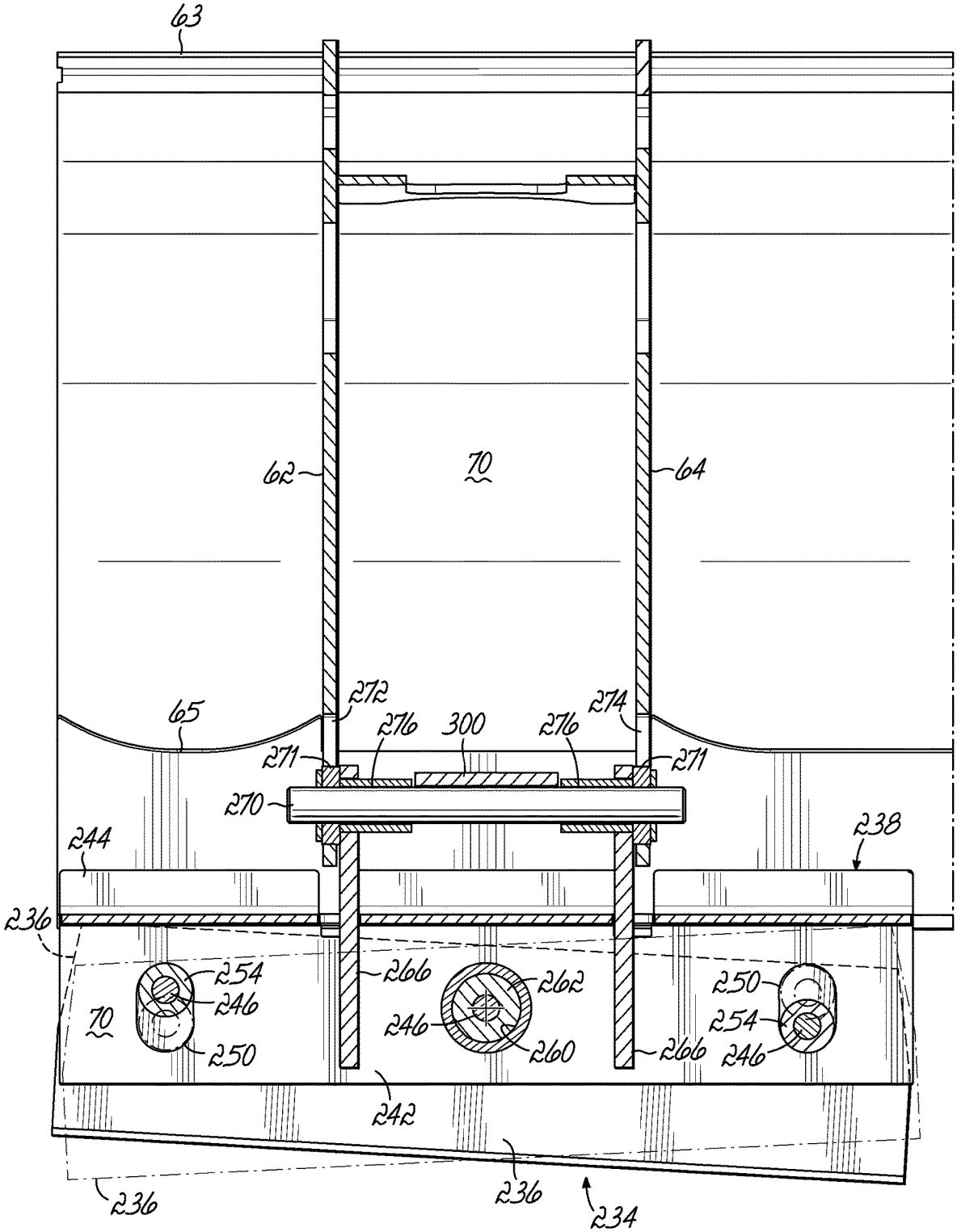
FIG. 14B is a view similar to FIG. 14A illustrating pivoting of the moldboard cutting edge segment about a point medially of its length.

In FIG. 14B, the cutting edge segment 236 is shown pivoting about the pivot axis generally perpendicular to the lower edge or edge region 232 of moldboard 70 as when encountering surface irregularities such as rises or depressions.

While the various features of the main blade cutting edge and the wing blade cutting edge have particular application for use with containment plows mountable to skid steers, wheeled loaders, and tractors, it will be appreciated that those features also have application to other types of plows such as straight-blade plows and V-blade plows mountable to other vehicles, such as pickup trucks. Accordingly, the various embodiments of the invention described and claimed are not limited to containment plows and skid steers/wheeled loaders/tractors.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A containment plow adapted to be mounted to a skid steer, a wheeled loader, or a tractor, comprising:

a moldboard frame, a moldboard mounted to said moldboard frame, a pair of wings, one wing of said pair of wings pivotally connected to said moldboard frame adjacent one end of said moldboard and the other wing of said pair of wings pivotally connected to said moldboard frame adjacent the other end of said moldboard, a moldboard cutting edge mounted to a lower edge of said moldboard and comprising a plurality of cutting edge segments, and a wing cutting edge mounted to a lower edge of each said wing, each said moldboard cutting edge segment mounted so as to have two rotational degrees of freedom movement relative to said moldboard and one translational degree of freedom movement relative to said moldboard, each said wing cutting edge mounted so as to have two rotational degrees of freedom movement relative to said wing, each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, and each said wing cutting edge is mounted to permit 1) pivoting movement about a third axis generally parallel to said lower edge of said wing, and 2) pivoting movement about a fourth axis generally perpendicular to said lower edge of said wing, wherein said second axis is positioned medially of a length of said moldboard cutting edge segment.

2. The plow of claim 1 wherein said wings are pivoted to said moldboard frame so as to be positionable forward and perpendicular to said moldboard, parallel to said moldboard, and rearward and perpendicular to said moldboard.

3. A containment plow adapted to be mounted to a skid steer, a wheeled loader, or a tractor, comprising:

a moldboard frame, a moldboard mounted to said moldboard frame, a pair of wings, one wing of said pair of wings pivotally connected to said moldboard frame adjacent one end of said moldboard and the other wing of said pair of wings pivotally connected to said moldboard frame adjacent the other end of said moldboard, a moldboard cutting edge mounted to a lower edge of said moldboard and comprising a plurality of cutting edge segments, and a wing cutting edge mounted to a lower edge of each said wing, each said moldboard cutting edge segment mounted so as to have two rotational degrees of freedom movement relative to said moldboard and one translational degree of freedom movement relative to said moldboard, each said wing cutting edge mounted so as to have two rotational degrees of freedom movement relative to said wing, each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, and each said wing cutting edge is mounted to permit 1) pivoting movement about a third axis generally parallel to said lower edge of said wing, and 2) pivoting movement about a fourth axis generally perpendicular to said lower edge of said wing, each said moldboard cutting edge segment is mounted to a respective moldboard cutting edge segment support plate, said support plate pivotally connected to said moldboard frame with a pivot pin, said pivot pin providing the pivoting movement of said segment about said first axis, each end of said pivot pin positioned in a slot in a rib of said moldboard frame, said slots providing the translational movement of said segment generally parallel to said lower edge of said moldboard, and wherein said segment is pivotally connected to said support plate with a fastener positioned medially of a length of said segment, said fastener providing the pivoting movement of said segment about said second axis.

4. The plow of claim 3 wherein a single biasing element biases said segment forward relative to said lower edge of said moldboard about said first axis and downward relative to said lower edge of said moldboard.

5. The plow of claim 4 further comprising a generally upwardly oriented link pivotally connected at a lower end to said support plate at a position aft of said pivot pin and slideably connected at an upper end to said moldboard frame, said biasing element comprising a compression spring, said link positioned within said compression spring, and an upper end of said compression spring captured against upward movement relative to said moldboard frame, whereupon rearward pivoting movement of said segment about said first axis compresses said spring and develops a forward pivoting restoring torque, and whereupon upward translational movement of said segment develops a downward translational restoring force.

6. A containment plow adapted to be mounted to a skid steer, a wheeled loader, or a tractor, comprising:

a moldboard frame, a moldboard mounted to said moldboard frame, a pair of wings, one wing of said pair of wings pivotally connected to said moldboard frame adjacent one end of said moldboard and the other wing of said pair of wings pivotally connected to said moldboard frame adjacent the other end of said moldboard, a moldboard cutting edge mounted to a lower edge of said moldboard and comprising a plurality of cutting edge segments, and a wing cutting edge mounted to a lower edge of each said wing, each said moldboard cutting edge segment mounted so as to have two rotational degrees of freedom movement relative to said moldboard and one translational degree of freedom movement relative to said moldboard, each said wing cutting edge mounted so as to have two rotational degrees of freedom movement relative to said wing, each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, and each said wing cutting edge is mounted to permit 1) pivoting movement about a third axis generally parallel to said lower edge of said wing, and 2) pivoting movement about a fourth axis generally perpendicular to said lower edge of said wing, each said wing cutting edge is mounted to a respective wing cutting edge support plate, said support plate pivotally connected to said wing with a first pin, said first pin providing the pivoting movement of said wing cutting edge about said third axis, and wherein said wing cutting edge is pivotally connected to said support plate with a fastener positioned adjacent an end of said wing cutting edge nearest to the pivot connection of said wing to said moldboard frame, said fastener providing the pivoting movement of said wing cutting edge about said fourth axis.

7. The plow of claim 6 further comprising:

a first biasing element biasing said wing cutting edge forward relative to said lower edge of said wing about said third axis, and a second biasing element biasing said wing cutting edge about said fourth axis so as to bias an end of said wing cutting edge furthest from the pivot connection of said wing to said moldboard frame downward relative to said lower edge of said wing.

8. The plow of claim 7 further comprising:

a support plate bracket secured to a rear surface of said wing, pivot pin ears secured to said wing cutting edge support plate and to said support plate bracket, said ears pivotally receiving said first pin, said first biasing element comprising a first torsion spring encircling said first pin and having first and second legs, said first leg of said first torsion spring engaging said support plate and said second leg of said first torsion spring engaging said support plate bracket, a second pin secured to said support plate and extending generally parallel to said first pin, said second biasing element comprising a second torsion spring encircling said second pin and having first and second legs, said first leg of said second torsion spring engaging said wing cutting edge and said second leg of said second torsion spring engaging said support plate, whereupon rearward pivoting movement of said wing cutting edge about said third axis twists said first torsion spring and develops a forward pivoting restoring torque, and whereupon upward pivoting movement of said end of said wing cutting edge furthest from the pivot connection of said wing to said moldboard frame twists said second torsion spring and develops a downward pivoting restoring torque.

9. The plow of claim 8 further comprising:

an L-shaped bracket having a leg and a foot, said leg positioned against a rear surface of said support plate and said foot extending rearwardly therefrom, and a bar attached to said support plate, said support plate having a slot therein, a fastener securing said wing cutting edge to said L-shaped bracket, said fastener passing through said slot, said first leg of said second torsion spring engaging said foot of said L-shaped bracket and said second leg of said second torsion spring engaging said bar.

10. A plow adapted to be mounted to a vehicle, comprising:

a moldboard frame, a moldboard mounted to said moldboard frame, and a moldboard cutting edge mounted to a lower edge of said moldboard and comprising a plurality of cutting edge segments, each said moldboard cutting edge segment mounted so as to have two rotational degrees of freedom movement relative to said moldboard and one translational degree of freedom movement relative to said moldboard, each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, wherein said second axis is positioned medially of a length of said moldboard cutting edge segment.

11. A plow adapted to be mounted to a vehicle, comprising:

a moldboard frame, a moldboard mounted to said moldboard frame, a pair of wings, one wing of said pair of wings pivotally connected to said moldboard frame adjacent one end of said moldboard and the other wing of said pair of wings pivotally connected to said moldboard frame adjacent the other end of said moldboard, and a wing cutting edge mounted to a lower edge of each said wing, each said wing cutting edge is mounted to permit 1) pivoting movement about a first axis generally parallel to said lower edge of said wing, and 2) pivoting movement about a second axis generally perpendicular to said lower edge of said wing, wherein said second axis is positioned adjacent the pivot connection of said wing to said moldboard frame.

12. A plow adapted to be mounted to a vehicle, comprising:

a moldboard frame, a moldboard mounted to said moldboard frame, and a moldboard cutting edge mounted to a lower edge of said moldboard and comprising a plurality of cutting edge segments, each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, wherein said second axis is positioned medially of a length of said moldboard cutting edge segment.

13. A plow adapted to be mounted to a vehicle, comprising:

a moldboard frame, a moldboard mounted to said moldboard frame, and a moldboard cutting edge mounted to a lower edge of said moldboard and comprising a plurality of cutting edge segments, each said moldboard cutting edge segment mounted so as to have two rotational degrees of freedom movement relative to said moldboard and one translational degree of freedom movement relative to said moldboard, each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, each said moldboard cutting edge segment is mounted to a respective moldboard cutting edge segment support plate, said support plate pivotally connected to said moldboard frame with a pivot pin, said pivot pin providing the pivoting movement of said segment about said first axis, each end of said pivot pin positioned in a slot in a rib of said moldboard frame, said slots providing the translational movement of said segment generally parallel to said lower edge of said moldboard.

14. The plow of claim 13 wherein a single biasing element biases said segment forward relative to said lower edge of said moldboard about said first axis and downward relative to said lower edge of said moldboard.

15. The plow of claim 14 further comprising a generally upwardly oriented link pivotally connected at a lower end to said support plate at a position aft of said pivot pin and slideably connected at an upper end to said moldboard frame, said biasing element comprising a compression spring, said link positioned within said compression spring, and an upper end of said compression spring captured against upward movement relative to said moldboard frame, whereupon rearward pivoting movement of said segment about said first axis compresses said spring and develops a forward pivoting restoring torque, and whereupon upward translational movement of said segment develops a downward translational restoring force.

16. A plow adapted to be mounted to a vehicle, comprising:

a moldboard frame, a moldboard mounted to said moldboard frame, a pair of wings, one wing of said pair of wings pivotally connected to said moldboard frame adjacent one end of said moldboard and the other wing of said pair of wings pivotally connected to said moldboard frame adjacent the other end of said moldboard, and a wing cutting edge mounted to a lower edge of each said wing, each said wing cutting edge mounted so as to have two rotational degrees of freedom movement relative to said wing, each said wing cutting edge is mounted to permit 1) pivoting movement about a first axis generally parallel to said lower edge of said wing, and 2) pivoting movement about a second axis generally perpendicular to said lower edge of said wing, wherein said second axis is positioned adjacent the pivot connection of said wing to said moldboard frame.

17. The plow of claim 16 wherein said wings are pivoted to said moldboard frame so as to be positionable forward and perpendicular to said moldboard, parallel to said moldboard, and rearward and perpendicular to said moldboard.

18. A plow adapted to be mounted to a vehicle, comprising:

a moldboard frame, a moldboard mounted to said moldboard frame, a pair of wings, one wing of said pair of wings pivotally connected to said moldboard frame adjacent one end of said moldboard and the other wing of said pair of wings pivotally connected to said moldboard frame adjacent the other end of said moldboard, and a wing cutting edge mounted to a lower edge of each said wing, each said wing cutting edge mounted so as to have two rotational degrees of freedom movement relative to said wing, each said wing cutting edge is mounted to permit 1) pivoting movement about a first axis generally parallel to said lower edge of said wing, and 2) pivoting movement about a second axis generally perpendicular to said lower edge of said wing, each said wing cutting edge is mounted to a respective wing cutting edge support plate, said support plate pivotally connected to said wing with a first pin, said first pin providing the pivoting movement of said wing cutting edge about said first axis, and wherein said wing cutting edge is pivotally connected to said support plate with a fastener positioned adjacent an end of said wing cutting edge nearest to the pivot connection of said wing to said moldboard frame, said fastener providing the pivoting movement of said wing cutting edge about said second axis.

19. The plow of claim 18 further comprising:

a first biasing element biasing said wing cutting edge forward relative to said lower edge of said wing about said first axis, and a second biasing element biasing said wing cutting edge about said second axis so as to bias an end of said wing cutting edge furthest from the pivot connection of said wing to said moldboard frame downward relative to said lower edge of said wing.

20. The plow of claim 19 further comprising:

a support plate bracket secured to a rear surface of said wing, pivot pin ears secured to said wing cutting edge support plate and to said support plate bracket, said ears pivotally receiving said first pin, said first biasing element comprising a first torsion spring encircling said first pin and having first and second legs, said first leg of said first torsion spring engaging said support plate and said second leg of said first torsion spring engaging said support plate bracket, a second pin secured to said support plate and extending generally parallel to said first pin, said second biasing element comprising a second torsion spring encircling said second pin and having first and second legs, said first leg of said second torsion spring engaging said wing cutting edge and said second leg of said second torsion spring engaging said support plate, whereupon rearward pivoting movement of said wing cutting edge about said first axis twists said first torsion spring and develops a forward pivoting restoring torque, and whereupon upward pivoting movement of said end of said wing cutting edge furthest from the pivot connection of said wing to said moldboard frame twists said second torsion spring and develops a downward pivoting restoring torque.

21. The plow of claim 20 further comprising:

an L-shaped bracket having a leg and a foot, said leg positioned against a rear surface of said support plate and said foot extending rearwardly therefrom, and a bar attached to said support plate, said support plate having a slot therein, a fastener securing said wing cutting edge to said L-shaped bracket, said fastener passing through said slot, said first leg of said second torsion spring engaging said foot of said L-shaped bracket and said second leg of said second torsion spring engaging said bar.

22. A containment plow adapted to be mounted to a skid steer, a wheeled loader, or a tractor, comprising:

a moldboard frame, a moldboard mounted to said moldboard frame, a pair of wings, one wing of said pair of wings pivotally connected to said moldboard frame adjacent one end of said moldboard and the other wing of said pair of wings pivotally connected to said moldboard frame adjacent the other end of said moldboard, a moldboard cutting edge mounted to a lower edge of said moldboard and comprising a plurality of cutting edge segments, and a wing cutting edge mounted to a lower edge of each said wing, each said moldboard cutting edge segment is mounted to permit, independent of an adjacent said segment, 1) pivoting movement about a first axis generally parallel to said lower edge of said moldboard, 2) pivoting movement about a second axis generally perpendicular to said lower edge of said moldboard, and 3) translational movement generally parallel to said lower edge of said moldboard, wherein said second axis is positioned medially of a length of said moldboard cutting edge segment.

* * * * *